US005587783A

United States Patent [19]

Nakamura et al.

[11] Patent Number: 5,587,783

[45] Date of Patent: Dec. 24, 1996

[54] COLOR ELECTROPHOTOGRAPHIC APPARATUS HAVING AN INTERMEDIATE TRANSFER BELT VARIABLE IN SPEED

[75] Inventors: Masahiko Nakamura, Yao; Hajime Yamamoto, Ibaraki; Hiroshi Terada, Ikoma, all of Japan

[73] Assignee: Matsushita Electric Industrial Co., Ltd., Osaka, Japan

[21] Appl. No.: 304,767

[22] Filed: Sep. 12, 1994

[30] Foreign Application Priority Data

| | | | |
|---|---|---|---|
| Sep. 16, 1993 | [JP] | Japan | 5-230070 |
| Sep. 22, 1993 | [JP] | Japan | 5-236224 |
| Nov. 1, 1993 | [JP] | Japan | 5-273434 |
| Nov. 5, 1993 | [JP] | Japan | 5-276407 |
| Jan. 28, 1994 | [JP] | Japan | 6-008257 |
| Jan. 28, 1994 | [JP] | Japan | 6-008258 |

[51] Int. Cl.[6] ..... G03G 15/01

[52] U.S. Cl. ..... 355/326 R; 355/271; 347/115

[58] Field of Search ..... 355/326 R, 327, 355/271, 273; 347/115, 138, 152

[56] References Cited

U.S. PATENT DOCUMENTS

| | | | |
|---|---|---|---|
| 4,743,938 | 5/1988 | Ohno | 355/327 |
| 4,987,455 | 1/1991 | Lubberts | 355/271 |
| 5,216,256 | 6/1993 | Kusumoto et al. | 250/548 |
| 5,229,820 | 7/1993 | McDougal et al. | 355/326 R X |
| 5,282,012 | 1/1994 | Terada et al. | 355/327 |
| 5,303,018 | 4/1994 | Terada et al. | 355/326 R |
| 5,335,056 | 8/1994 | Muramatsu | 355/327 |
| 5,351,115 | 9/1994 | Yamamoto et al. | 355/326 R |

FOREIGN PATENT DOCUMENTS

| | | |
|---|---|---|
| 4228365 | 3/1993 | Germany . |
| 60-162271 | 8/1985 | Japan . |
| 62-287264 | 12/1987 | Japan . |

OTHER PUBLICATIONS

European Search Report dated Jan. 24, 1996. EP 94 114528.

*Primary Examiner*—Nestor R. Ramirez
*Attorney, Agent, or Firm*—Ratner & Prestia

[57] ABSTRACT

A color electrophotographic apparatus using a plurality of image forming units. The entire image forming unit group moves by rotation, and a toner image is transferred on an intermediate transfer belt at an image forming position. The intermediate transfer belt is variable in speed, and while the image forming unit group is moving, it is stopped or runs at low speed. The hopper in the image forming unit is divided into two sections. The toner is supplied the image forming position, and when the toner remainder sensor detects no remaining toner, the image forming unit group rotates by one revolution or more, and then the toner remainder is detected again to judge presence or absence of toner remainder. At this time, the toner in the toner hopper is agitated by the agitating member and the shape of the inner wall. After rotary move of the image forming unit group, each image forming unit is initialized sequentially. The side walls of the signal light optical path are composed of image forming units, and the color of the side walls is black. The gap between two adjacent signal forming units is 20 mm or less. One erase lamp of the photosensitive member is provided near the image forming position. During rotary motion of the image forming unit group, it is controlled so as not to disturb the toner image on the intermediate transfer belt.

13 Claims, 12 Drawing Sheets

Direction of axis of rotation of unit group (Longitudinal direction of units)

COLOR ELECTROPHOTOGRAPHIC APPARATUS HAVING AN INTERMEDIATE TRANSFER BELT VARIABLE IN SPEED

BACKGROUND OF THE INVENTION

1. Industrial Field of Utilization

The present invention relates to a color electrophotographic apparatus applicable in color printer, color copier, color facsimile apparatus or the like, and an image forming unit for use therein.

2. Related Art of the Invention

Generally, to form a color image by electrophotography, color toner images of yellow, magenta, cyan and black are overlaid on a transfer member, and a color image is composed. One of such color image forming methods is the transfer drum method, in which color toner images are sequentially formed on one photosensitive member, and a transfer member wound on the transfer drum is repeatedly set opposite to the photosensitive member, and the color toner images formed thereon are overlaid and transferred. Other known method is the continuous overlay method, in which plural image forming parts are set sequentially, and the transfer member conveyed by a belt passes the transfer position of the image forming parts to overlay the color toner images.

An example of employing the former transfer drum method is a color image forming apparatus disclosed in the Japanese Laid-open Patent No. 1-252982. FIG. 1 shows a general structural outline of this prior art. Its constitution and operation are briefly described below. In FIG. 1, reference numeral 1 denotes a photosensitive member, 2 is a charger, 3 is a developing device, 4 is a transfer drum, and 5 is a cleaner. The developing device 3 consists of a Y developing unit 6 for making a yellow color toner image, an M developing unit 7 for magenta color, a C developing unit 8 for cyan color, and Bk developing unit 9 for black color. The entire body of the developing device 3 rotates, and each developing unit sequentially confronts the photosensitive member 1 to be ready to develop. Each developing unit has a toner hopper 10 to be refilled with toner from outside, and a color toner corresponding to each developing unit is supplied from each hopper. The toner concentration is detected by optical detecting means, on a developing roller at the developing position, and the toner is supplied from a position moved 90 degrees from the developing position. In monochromatic continuous mode, when the toner concentration is lowered, the entire developing device rotates, and the toner is supplied at the toner supply position. The toner fed from the hopper 10 is conveyed in a pipe (not shown). The pipe is supplied from the toner refill port (not shown) provided in part of the central shaft through the rotation central shaft of the rotary developing apparatus into the developing unit by gravity. The toner supplied in each developing unit is circulated in the axial direction by a screw (not shown) provided in each developing unit.

The transfer drum 4 and photosensitive member 1 rotate at a specific speed in the arrow direction while confronting each other. When the operation starts, the photosensitive member 1 rotates in the arrow direction, and its surface is uniformly charged by the charger 2. Afterwards, the surface of the photosensitive member is irradiated with a laser beam 11 modulated by signal in order to form a yellow image of the first color, and a latent image is formed. This latent image is first developed by the yellow developing unit 6 confronting the photosensitive member, and a yellow toner image is formed. Until the formed yellow toner image comes to the position confronting the transfer drum 4, already a sheet of paper is wound on the outer circumference of the transfer drum 4, as the transfer member sent from a paper feed unit 12, with its front end clipped by a claw 13. The timing is adjusted so that the yellow toner image on the photosensitive member may confront the specified position of the paper, and then the toner image is formed.

The yellow toner image on the photosensitive member is transferred on the paper by the action of a transfer charger 14. Later, the surface of the photosensitive member is cleaned by the cleaner 5, making it ready to form an image of next color. In succession, toner images of magenta, cyan and black are similarly formed, and at this time the developing device 3 sets each developing unit to confront the photosensitive member depending on the color so as to be ready to be developed. The diameter of the transfer drum is enough to take up the longest paper and exchange the developing units between formations of color images.

Irradiation of laser beam 11 for forming color images is adjusted in timing so that the toner image of each color on the photosensitive member may be matched in position with the toner image already transferred on the paper on the transfer drum. In this way, toner images of four colors are overlaid and transferred on the paper on the transfer drum 4, and a color image is formed on the paper. When toner images of all colors are transferred, the paper is peeled off the transfer drum 4 by a parting claw 15, and through the conveying unit 16, the above toner image is fixed by a fixing device 17, and the paper is discharged out of the apparatus.

The initial operation of this apparatus is described. When the apparatus power source is turned on, the fixing device 17 begins to heat up. Coming closer to the specified temperature, the apparatus starts to operate same as in the image forming operation above. At this time, the laser beam 11 is not emitted. Each developing unit sequentially opposes the photosensitive member, and an image is formed for a specific time. This action is done by each developing unit, and the apparatus stands by in a state ready for starting image formation, thereby terminating the initial action.

On the other hand, as an example of color image forming apparatus using continuous transfer system, the Japanese Laid-open Patent No. 1-250970 is disclosed. In this example, four image forming stations including the photosensitive member and light scanning means are arranged, and the paper conveyed by belt passes through each transfer unit, and toner images are overlaid.

A further different method is disclosed in the Japanese Laid-open Patent No. 2-183276. This is a method of overlaying toner images of colors sequentially formed on the photosensitive member once on an intermediate transfer unit, and finally moving them to the transfer member in batch.

Recently, aiming at downsizing and easier maintenance of such apparatus, the Japanese Laid-open Patent No. 62-287264 is disclosed. This apparatus is explained by reference to FIG. 2. Herein, plural image forming units are hold on a rotary support, and the image forming unit is exchanged for one exposure position, and a color image is formed on the paper wound on the transfer unit. In FIG. 2, reference numeral 18 is a rotary frame for rotatably supporting four image forming units 19*a*, 19*b*, 19*c*, 19*d* for cyan, magenta, yellow and black, and it is held by a support shaft 20 and rotates in coincidence with the timing of development. Units containing four color toners are identical in constitution, and only the toners are different. The construction of this image forming unit, and the image forming process are described in detail below by reference to the image forming unit 19*a* stopped at the image forming position.

The image forming unit 19*a* comprises a photosensitive drum 21, a charger 22, and a cleaner unit 23. Outside the image forming unit 19*a* is provided a semiconductor laser (not shown), and the signal light emitted from the laser is exposed and scanned by a polygon 24 on the photosensitive drum 21 in the axial direction. In FIG. 2, reference numeral 25 denotes a lens system, and 26 is a mirror for varying the direction of the laser beam. The signal light issued from the semiconductor laser depending on the image signal of each color exposes the photosensitive drum 21 which is charged by the charger 22, and forms an electrostatic latent image. Afterwards, this electrostatic latent image is developed by a developing device 27, and a toner image is formed on the photosensitive drum 21. On the other hand, the transfer member is wound on the surface of a transfer drum 28. The toner image formed on the photosensitive drum 21 is transferred by a transfer charger 29 provided inside the transfer drum 28. After transfer, the toner left over on the photosensitive drum 21 is cleaned by the cleaner unit 23. After being discharged an erase lamp 30, the photosensitive drum 21 stops its rotation. After such image forming action, the rotary frame 18 rotates 90 degrees, and exchanges the units. At the lowest image forming position, a unit 19*b* moves instead of the unit 19*a*, and is fixed. Next, an image is formed by using the unit 19*b*. According to the image signal corresponding to the color of the unit 19*b*, semiconductor laser is modulated, and a latent image is formed and developed, and overlaid and transferred on the transfer member wound on the transfer drum 28. The subsequent process is same as in the case of the unit 19*a*. In this way, the image forming process is conducted in four units, and toner images of four colors are overlaid on the transfer member, so that a color image is formed. Afterwards, the transfer member is separated from the transfer drum 28, fixed by the fixing device, and is discharged out of the machine.

This ends the brief description of the constitution and operation of the prior art.

However there is the following problems in the prior art. In the transfer drum type in FIG. 1, paper must be wound on the transfer drum, and the diameter of the transfer drum must be more than a specific size, and its structure is complicated, and hence the size was large. Yet, postcard, thick paper or tenacious paper that cannot be wound on the transfer drum could not be used. Furthermore, when exchanging the photosensitive member, it required complicated maintenance such as adjustment of each developing unit according to the characteristic of the photosensitive member. Accordingly, the maintenance required skilled specialists. Besides, the photosensitive member, developing device, and toner hopper were separately constituted. It hence required a large and complicated mechanism for sending the toner from the hopper to the developing device. Or when the apparatus was left over in the environments of high temperature and high humidity for a long time, the fluidity of the toner in the hopper was lowered, and the toner was solidified in the toner hopper and in the refill route. It caused toner supply shortage, drop of toner concentration in the developing device, and deterioration of image quality. At this time, if the toner was left over enough in the hopper, the toner remainder detecting sensor sometimes issued a wrong toner empty signal. Moreover, because of the constitution for supplying the toner into the rotating and moving developing device from a fixed external unit, the toner spilled while the developing device was moving.

Once the toner was solidified, still more, if the initial action is started by turning on the power source, the toner could not be agitated sufficiently, and the toner electric charge amount was insufficient, and a background was overlaid on the initial image. If the initial action time of each developing unit is prolonged in order to solve the problem of toner solidification, it took too much time, and induced side effects such as fatigue of photosensitive member to shorten the life of photosensitive member. Meanwhile, in the constitution in FIG. 1, if the toner in the developing device was stirred by making use of the rotary motion of the developing unit group, toner solidification could not be eliminated. Still worse, toner scattered violently from the developing roller, and it caused a problem of toner contamination inside the machine.

On the other hand, the continuous transfer method does not require the transfer drum as in FIG. 1, but it requires, instead, latent image forming means such as laser optical system for forming latent image on the photosensitive member by the same number as the number of colors, and the structure is complicated and expensive. Besides, there are plural image forming positions, and the relative positional deviation of image forming part of each color directly leads to color deviation. In particular, as shown in the example disclosed in the Japanese Laid-open Patent No. 1-250970, it requires accurate positioning of colors of latent images by the latent image forming means, and hence requires due consideration and complicated constitution of the image exposure system as latent image forming means. Along with the complicatedness of such positioning, when replacing parts such as photosensitive members at the time of maintenance, it was difficult to reproduce the accurate positioning, and complicated maintenance was needed.

Furthermore, in the example of using the intermediate transfer member disclosed in the Japanese Laid-open Patent No. 2-183276, since developing units of all colors are disposed around one photosensitive member, the shape of the photosensitive member is large. The maintenance of developing device and photosensitive member was also difficult. For example, for maintenance of the developing device, it required image adjustment and position adjustment with the photosensitive member.

In the apparatus shown in FIG. 2, the gap is wide between two adjacent image forming units for composing the optical path being held on a rotary support. On the side of the image forming unit group in the state being installed in the apparatus, various gaps are opened. Accordingly, when forming an image, the lights from the heat lamp of the fixing device, erase lamp, and others from outside expose the photosensitive member as strayed lights, which caused background on the image. In this apparatus, at the time of rotary motion for exchanging the image forming units, the toner image on the transfer member contacted with the image forming unit, and the toner image was disturbed, and a favorable color image could not be obtained.

SUMMARY

It is hence a primary object of the invention to present a excellent color electrophotographic apparatus and image forming unit in a small and simple structure, not requiring complicated transfer drum, and capable of solving the above problems.

It is other object of the invention to present a excellent color electrophotographic apparatus and image forming unit capable of matching the color positions accurately, without requiring the structure for positioning of the image exposure system.

It is another object of the invention to present an excellent color electrophotographic apparatus and an image forming unit being low in maintenance.

It is a different object of the invention to present a color electrophotographic apparatus being free from disturbance of toner image.

It is a further object of the invention to present an excellent color electrophotographic apparatus being free from wrong detection of toner remainder, and capable of supplying toner stably without causing toner clogging or the like when replenishing with toner.

It is a further different object of the invention to present an excellent color electrophotographic apparatus capable of stirring the toner sufficiently if let stand in environments of high temperature and high humidity for a long period, not causing background even on the first image after letting stand.

It is still other object of the invention to present an excellent color electrophotographic apparatus capable of producing a color image of excellent image quality, without causing background due to strayed light in the apparatus.

It is a still different object of the invention to present an image forming unit capable of stirring the toner sufficiently, without adding extra constitution such as toner stirring screw to the image forming unit.

The present invention is for example, a color electrophotographic apparatus comprising:

an image forming unit group containing plural image forming units comprising a photosensitive member, and developing means having a toner of different color than others and forming a toner image on the photosensitive member, a movable transfer member on which a toner image on the photosensitive member is overlaid and transferred at a single transfer position, and a color image is formed, driving means for driving by changing over a moving speed of the transfer member to a first running speed used when forming an image, or stopping or a second running speed slower than the first running speed, exposure means for exposing the image at a single exposure position having a specific corresponding relation with the transfer position, and moving means for moving the image forming unit group for sequentially positioning the plural image forming units at image forming position for image exposure and transfer, wherein the transfer member is driven at the second running speed while the image forming unit group is moving.

DETAILED DESCRIPTION OF THE INVENTION

Actions and effects of the color electrophotographic apparatus in fundamental embodiments of the invention are described below while referring to the accompanying drawings.

Figure 3:
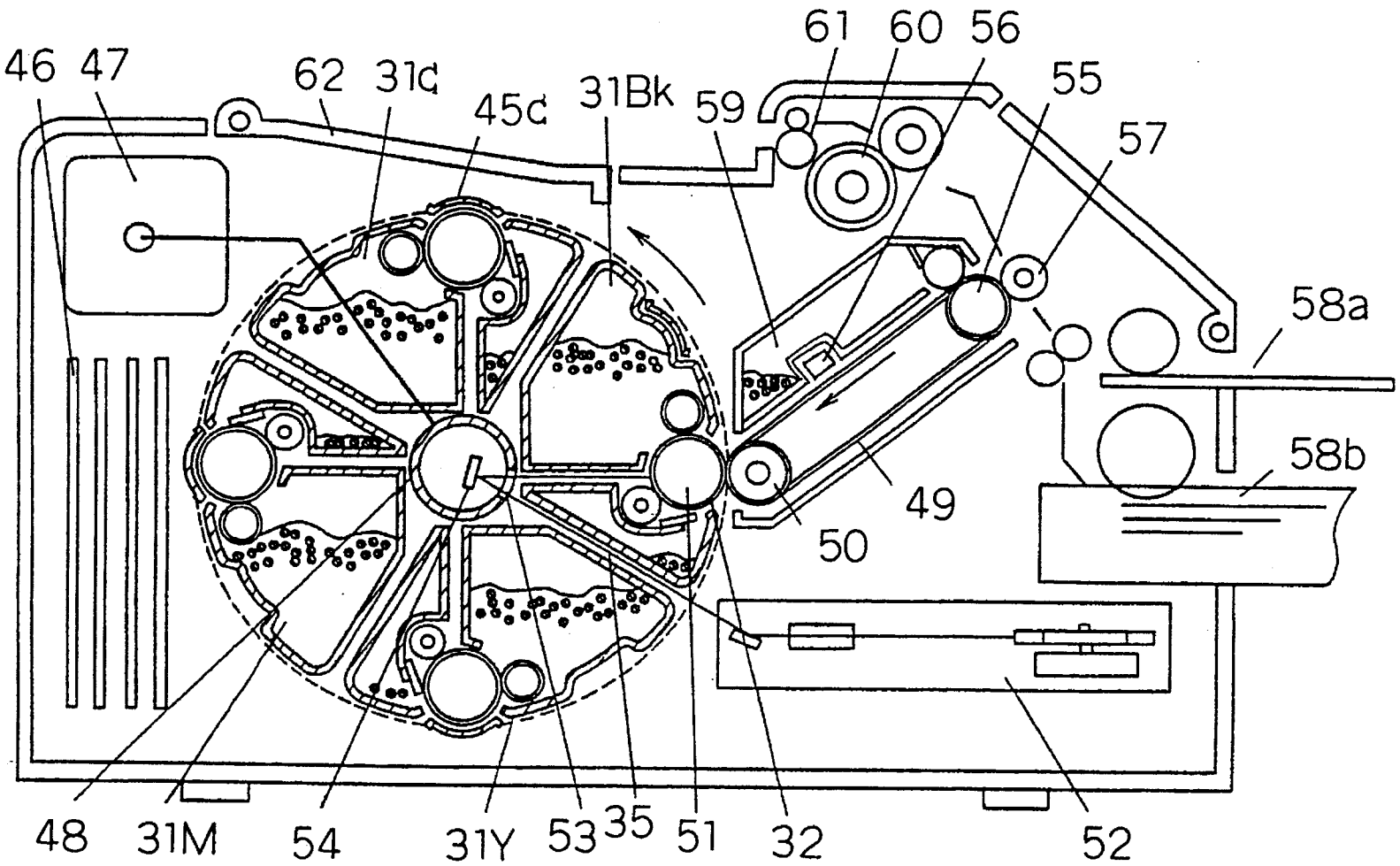
FIG. 3 is structural diagram of a color electrophotographic apparatus in an embodiment of the invention.

FIG. 3 is a general structural diagram of a color electrophotographic apparatus of the invention.

Figure 4:
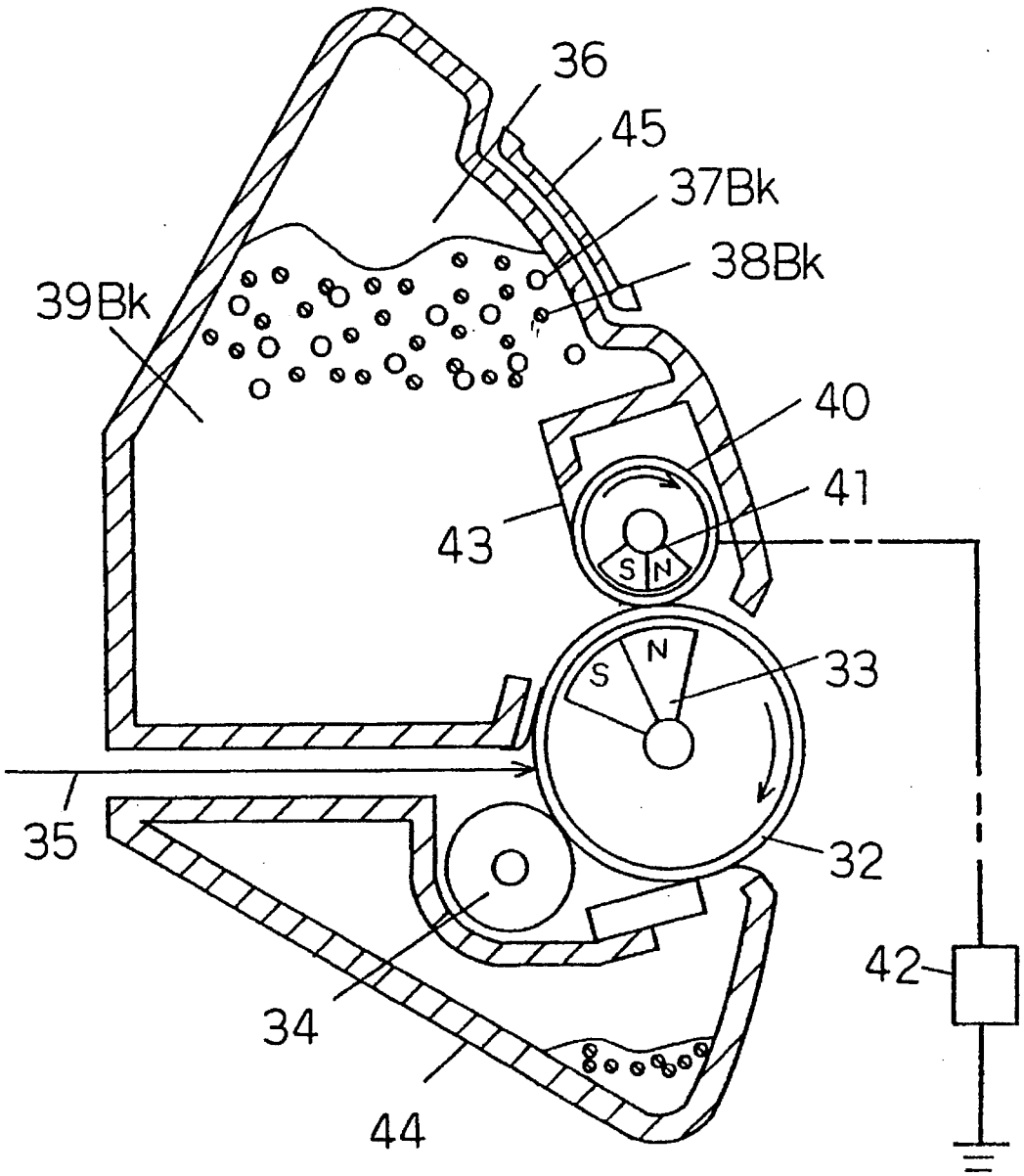
FIG. 4 is a structural diagram of an image forming unit used in a color electrophotographic apparatus in an embodiment of the invention.

In the center of the apparatus, four sector-shaped image forming units 31Bk, 31Y, 31M, 31C of black, yellow, magenta, and cyan compose an image forming unit group, and are disposed in an annular form as shown in the drawing. The image forming units are composed of same members except for the developer contained inside, and the image forming unit for black is described for simplification of explanation, and units for other colors are omitted. For individual colors, same parts are given by same reference numerals, and color codes are attached if necessary to distinguish by color. FIG. 4 shows the detail of the image forming unit 31Bk for black.

In FIG. 4, reference numeral 32 is an organic photosensitive member having phthalocyanine dispersed in a polycarbonate binder resin, 33 is a magnet which does not rotate as being fixed coaxially with the photosensitive member 32, 34 is a charging roller for charging the photosensitive member electrically in the negative polarity, 35 is a signal light by laser beam, and 36 is a toner hopper.

In the toner hopper 36, two-component developer 39Bk mixing toner 38Bk and ferrite carrier 37Bk of 50 μm in particle size having the surface coated with silicone resin is charged, and is adhered to the surface of the photosensitive member 32 by magnetic force. The toner to be used is prepared by dispersing pigment or the like in polyester resin, and further adding additives.

Reference numeral 40 is a rotatable recovery electrode roller made of aluminum, 41 is a magnet which does not rotate as being fixed coaxially in the inside thereof, 42 is an alternating-current high voltage power source for applying a voltage to the recovery electrode roller, and 43 is a scraper made of polyester film for scraping off the toner on the recovery electrode roller. The diameter of the photosensitive member 32 is 30 mm, and it is rotated in the arrow direction at peripheral speed of 60 mm/s. The diameter of the recovery electrode roller 40 is 16 mm, and it is rotated in the arrow direction at peripheral speed of 60 mm/s. Reference numeral 44 is a cleaner for cleaning the toner left over on the surface of the photosensitive member after transfer.

The image forming unit in FIG. 4 is an image forming unit for black, and it shows the vertical arrangement of the image forming unit at the image forming position. In the drawing, the toner hopper 36 containing the developer 39Bk is positioned at the upper side of the direction of gravity of the photosensitive member 32, while the cleaner 44 is positioned at the lower side. Accordingly, in the toner hopper, the developer is supplied on the photosensitive member 32 by its own weight, and in the cleaner, hence, the toner scraped off by the blade drops into the bottom of the cleaner by its own weight. In this way, development and cleaning can be done smoothly without installing feed mechanism or stirring mechanism for moving the toner inside the toner hopper or cleaner.

In the invention, the toner concentration detection and toner supply of each image forming unit are conducted at the image forming position, and therefore the toner concentration is not lowered if a single color is produced continuously, and a stable image is produced.

Reference numeral 45 is a photosensitive member cover for protecting the photosensitive member 32. FIG. 4 shows the opened state for forming an image. This photosensitive member cover 45 covers the photosensitive member when the image forming unit is at other position than the image forming position, and prevents contamination of the photosensitive member, or contamination with toner during rotary motion of the image forming unit.

The constitution is the same in the other developing units 31Y, 31M, 31C than the one for black.

Referring again to FIG. 3, the constitution of the printer is described. Image forming units 31Bk, 31Y, 31M, 31C disposed in an annular form are supported by a support (not shown), and, on the whole, are driven by a driving motor 47 which is driving means controlled by a control circuit 46, and are rotatable in the arrow direction around a cylindrical fixed shaft 48 which does not rotate. The image forming units are sequentially moved to the image forming position 51 confronting a first transfer roller 50 for supporting an intermediate transfer belt 49 described later, and are positioned. The image forming position 51 is also the exposure position by signal light 35. The peripheral length of the photosensitive member from the exposure position to the transfer position on the photosensitive member 32 at the image forming position (the corresponding length on the photosensitive member surface on the basis of the rotating direction of the photosensitive member) is 45 mm. The support of the image forming unit 31Bk, 31Y, 31M, 31C possesses means (not shown) for detecting the move of each image forming unit to the image forming position 51, and every time the move of each unit is over, a signal corresponding to the completion of movement is sent to the control circuit 46. This detecting means detects the completion of movement in this embodiment, but, needless to say, it may also detect the position of the unit on the way of moving as far as the means is capable of predicting the motion completion time accurately.

Reference numeral 52 is a laser exposure device, which generates signal light 35 by laser beam modulated by a signal entered in the printer unit, and it passes through an optical path constituted between the sector shapes of image forming units 31Bk and 31Y in FIG. 3, and is entered in a mirror 54 fixed inside a shaft 48 through a transparent window 53 opened in part of the shaft 48, and is reflected and emitted to the photosensitive member 32 of the image forming unit at the image forming position 51, and a latent image is formed. In the state in FIG. 3, it acts on the image forming unit 31Bk for black.

Herein, the optical path up to the mirror 54 is composed of a plane nearly parallel to the light scanning surface, by making use of the gaps formed on the outer walls of the adjacent image forming units, so that it may be composed in narrow gaps without disturbing the optical path. If the gap of the adjacent image forming units is wide, the strayed light entering the optical path increases. When the gap width is limited under 20 mm, the strayed light entering the optical path of signal light can be decreased, and effects of strayed light can be substantially eliminated. Furthermore, by forming the outer wall of each image forming unit in black, if strayed light invades into the optical path, the reflected light is weak, and the effect on the photosensitive member surface potential can be decreased. The side wall of the optical path (the front and rear side of the drawing) is formed of a rotary support of the image forming unit group, and prevents invasion of strayed light from the side.

Besides, the mirror 54 is formed in the middle of the image forming unit group, and therefore it can be composed of only one fixed mirror, so that the structure may be simple and high in positioning reliability. Besides, the optical path is disposed so that the reflection plane of the mirror 54 may be downward, and structurally dust in the machine hardly deposits on the reflection plane.

Reference numeral 49 is an intermediate transfer belt, and is made of a film mainly composed of a semiconductive urethane base of endless belt form of 100 m in thickness, and is suspended on a first transfer roller 50 having low resistance treated urethane foam formed on the periphery and a second transfer roller 55 made of stainless steel, and is movable in the arrow direction. The width (the width in the longitudinal direction in the drawing) of the intermediate transfer belt 49 is broader than the maximum image width (A4 in the case of this embodiment), and a mark (not shown) for detecting the position corresponding to the running direction of the belt is provided out of the image range on the intermediate transfer belt 49. The support (not shown) of the intermediate transfer belt 49 is provided with an optical position detection sensor 56 at a position capable of detecting this mark. The position detection sensor 56 is composed of a transmission unit and a reception unit, and the position is detected by receiving the reflected light produced from the transmission unit. In this embodiment, as position detecting means of belt, optical detecting means of reflection type is used, but position detecting means of transmission type may be also used. Aside from the optical type, of course, the detecting means of mechanical type, electric type, magnetic type or the like may be also used.

In the invention, the peripheral length from the transfer position on the transfer member to the image front end position (the corresponding length on the transfer member surface on the basis of the rotating direction of the transfer member) when detecting the position of the transfer member is set longer than the peripheral position from the exposure position to the transfer position on the photosensitive member. Hence, after detecting the position of the transfer member, the signal exposure can be started, and accurate positioning is done in a short image forming time.

In the invention, after changing over the speed of the transfer member from low speed to ordinary speed, the position of the transfer member is detected when reaching a specific speed. Accordingly, the running distance of the transfer member is constant from the position detecting moment till the transfer point, so that the positioning precision is enhanced. In this constitution, since the size of the intermediate transfer member may be small, the apparatus may be downsized, and overlapping positioning of toner images of various colors may be done easily and accurately on the intermediate transfer member.

When this position detecting sensor 56 detects the mark on the intermediate transfer belt 49, image formation is started with the image forming unit 31 at the image forming position 51. The position detecting sensor 56 is at a position of 50 mm at the upstream side of the belt running direction from the transfer position on the intermediate transfer belt 49.

In the example of the invention, a pulse motor (not shown) is used as the driving means of the intermediate transfer belt 49. At this time, the changeover time of the intermediate transfer belt 49 between the stopping state and ordinary running at 60 mm/s is 0.1 s in acceleration and 0.05 s in deceleration. When the belt driving load is large, the time required for changing over the speed is long, and fluctuation is large, too. By contrast, the time required for changeover the intermediate transfer belt 49 between low speed running of 10 mm/s and ordinary running of 60 mm/s is about half, in both acceleration and deceleration, as compared with the case of stopping the belt. Yet, if the belt driving load increases, fluctuation is hardly caused. Therefore, when the driving load is large, it is more effective in the method of changing over the speed between the low speed running at 10 mm/s or less and the ordinary running of 60 mm/s, than in the method of changing over between stopped state and ordinary running. In this embodiment, the intermediate transfer belt 49 is for A4 size and is small, and the driving load is small, and hence the changeover system of stopped state and ordinary running is employed.

In the example of the invention, moreover, the peripheral length of the intermediate transfer belt 49 is set longer by 80 mm than the maximum printing length (in this invention, the longitudinal length of A4 size paper). This is a setting by summing up 20 mm of running distance of the belt required for the intermediate transfer belt 49 to be stabilized in speed when changing over the speed between the stopped state and the ordinary running of 60 mm/s, 50 mm of distance from the transfer position of the intermediate transfer belt to the image end when the position is detected by the position detecting sensor 56, and 10 mm of an allowance. By so setting the peripheral length of the intermediate transfer belt 49, the speed of the intermediate transfer belt 49 when detecting the position is always an ordinary running at 60 mm/s.

In a color electrophotographic apparatus for overlaying color images on an intermediate transfer member, when the intermediate transfer member is driven at a constant speed, the peripheral length of the transfer member must be set by adding the moving distance the transfer member runs in the time required for moving the image forming unit. If this length is short, the image front end position on the transfer member passes through the transfer position before the move of the image forming unit is over, and color position matching is disabled. The time required for moving the image forming unit is likely to fluctuate because the weight of the image forming unit changes, and it is difficult to determine the peripheral length of the transfer member singly. In particular, in the apparatus of high image forming speed, the distance of non-image portion for positioning is very long, and the apparatus is huge. By the constitution of the invention, it is not necessary to extend the peripheral length of the transfer member, so that the apparatus may be reduced in size.

A first transfer roller 50 is pressed to the photosensitive member 32 of the image forming unit 31Bk at the image forming position 51 through the intermediate transfer belt 49. A second transfer roller 55 contacts with a third transfer roller 57 in a same constitution as the first transfer roller 50 through the intermediate transfer belt 49 so as to be driven and rotatable.

In the nip area compressed by the intermediate transfer belt 49 and third transfer roller 57, a paper conveying route is formed so that the paper may be sent forth from the paper feed units 58*a* and 58*b*. Reference numeral 59 is a belt cleaner for cleaning the intermediate transfer belt. Reference numeral 60 denotes a fixing device for fixing the toner image on the paper after transfer, and 61 is a discharge roller for discharging the paper after the fixing step.

So far is the explanation of the principal constitution of the electrophotographic apparatus and image forming unit of the invention.

Next is explained the operation of color image forming by this apparatus. First of all, the image forming units are at the positions shown in FIG. 3, and the image forming unit 31Bk for black is positioned at the image forming position 51. It also confronts the first transfer roller 50. From the laser exposure device 52, black signal light is fed into the image forming unit 31Bk, and the operation of the image forming unit is started, thereby forming an image by black toner.

Referring now to FIG. 4, the operation of the image forming unit is described below. The photosensitive member 32 was charged at −500 V by the charging roller 34. This photosensitive member 32 was illuminated with signal light 35 by laser beam, and an electrostatic latent image was formed. At this time, the exposure potential of the photosensitive member was −100 V. On the surface of this photosensitive member 32, two-component developer 39Bk was adhered by magnetic force in the toner hopper 36. Consequently, the surface of the photosensitive member 32 passed before the recovery electrode roller 40. When uncharged zone of the photosensitive member 32 passed, an alternating-current voltage (frequency 1 kHz) of 750 V 0-p (peak to peak 1.5 kV) superposing a direct-current voltage of +100 V was applied on the electrode roller 40 by an alternating-current high voltage power source 42. Then, charging at −500 V, when the surface of the photosensitive member 32 in which the electrostatic latent image was written passed, an alternating-current voltage (frequency 1 kHz) of 750 0-p (peak to peak 1.5 kV) superposing a direct-current voltage of −350 V was applied on the electrode roller 40 by the alternating-current high voltage power source 42. As a result, the carrier on the photosensitive member 32 and the toner depositing on the charged part were recovered in the electrode roller 40, and a negative-positive inverted toner image was left over only in the image area on the photosensitive member 32. The carrier and toner depositing on the electrode roller 40 rotating in the arrow direction was scraped off by the scraper 43, and put back into the toner hopper 36, and was used for next image forming. In this way, a black toner image was obtained on the photosensitive member 32. Back to FIG. 3 again, the description continues.

At this time, it is set so that the image forming speed of the image forming unit 31Bk (equal to the peripheral speed of the photosensitive member) and the moving speed of the intermediate transfer belt 49 may be equal to each other, and simultaneously when the image is formed, a black toner image is transferred on the intermediate transfer belt 49 by the first transfer roller 50. Right after transfer of all black toner images, the intermediate transfer belt 49 stops, and the image forming units 31Bk, 31Y, 31M, 31C are entirely driven by the driving motor 47, and integrally rotated in the arrow direction in FIG. 3, and after rotating exactly 90 degrees, they are stopped at the position where the image forming unit 31Y reaches the image forming position 51. During this move, the intermediate transfer belt 49 is stopped. The toner hopper 36 (see FIG. 4) other than the photosensitive member of the image forming unit 31 is positioned inside of the rotary arc (indicated by broken line in FIG. 3) at the front end of the photosensitive member, and therefore the intermediate transfer belt will never touch the image forming unit.

When the image forming unit 31Y reaches the image forming position 51, the stopped intermediate transfer belt 49 is driven again, and begins to move. The position detecting sensor 56 detects the position of the intermediate transfer belt 49 which has begun to run again, and issues a signal for starting signal formation. Corresponding to this signal, same as before, the laser exposure device 52 feeds a yellow signal into the image forming unit 31Y, and a yellow toner image is formed. At this time, the timing is adjusted so that the former black toner image and the yellow toner image may be matched in position on the intermediate transfer belt 49. At this time, the third transfer roller 57 and cleaner 59 are slightly departed from the intermediate transfer belt, so that the toner image on the belt may not be disturbed.

The same action is conducted for magenta and cyan, and toner images of four colors are matched in position and overlaid on the intermediate transfer belt 49, thereby forming a color image. After transfer of the final cyan toner image, the toner images are transferred at once by the action of the third transfer roller 57 on the paper sent from the paper feed unit 58*a* or 58*b* by matching the timing. The toner images transferred on the paper are fixed by a fixing device 60. The paper is then discharged out of the apparatus through a discharge roller 61. The toner after transfer left over on the intermediate transfer belt is cleaned by the action of the cleaner 59 to be ready for next image forming.

The operation in monochromatic mode is described below. In monochromatic mode, in the first place, the image forming unit of a specified color is moved to the image forming position 51, and is positioned. Next, same as before, image forming and transfer of toner image on intermediate transfer belt are conducted, and, successively, the toner image is transferred onto the paper sent from the paper feed unit by the third transfer roller.

Figure 5:
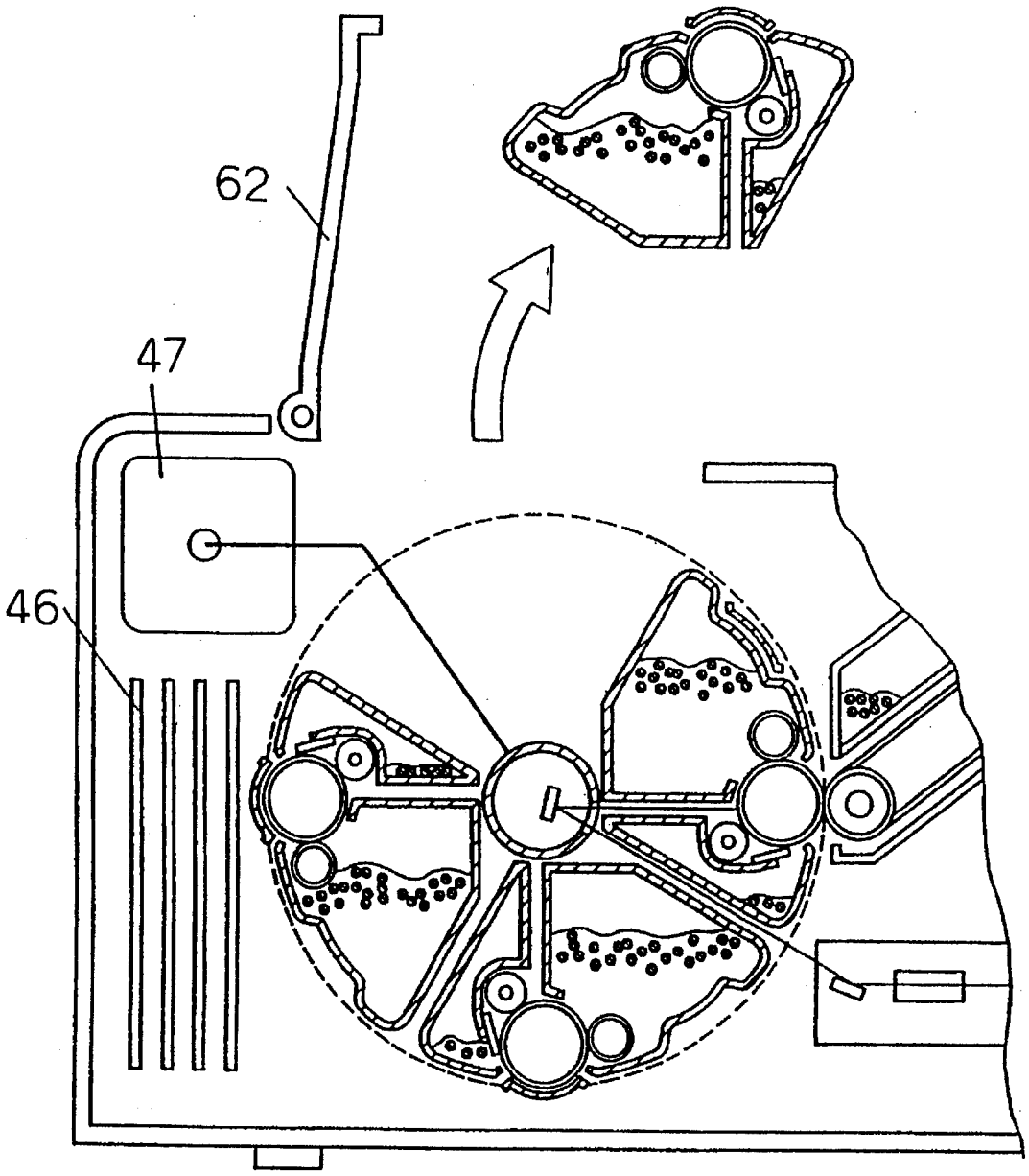
FIG. 5 is an explanatory diagram for exchanging image forming units.

Referring next to FIG. 5, the maintenance of this apparatus is described below.

Explained is a case of replacing the image forming unit as the developer of a specific color is spent out. First, by the command from the operator (by a switch not shown), the driving motor 47 controlled by the control circuit 46 is operated, and the image forming unit group is rotated, and the image forming unit of the specific color is moved to the printer upper position (position of image forming unit 31C in FIG. 3). Then, as shown in FIG. 5, the operator opens the cover 62 positioned in the upper pat of the apparatus main body, and dismounts the image forming unit of the specific color out of the apparatus. Consequently, a pre-adjusted new image forming unit is mounted. After mounting, therefore, image forming can be started without doing any adjustment. At this time, since the photosensitive member cover is closed, the operator will not touch the photosensitive member. Besides, the image forming unit to be replaced is replaced at an upper position different from the image forming position, and therefore contact with relating member of transfer unit is avoided. Moreover, the maintenance is easy because dismounting procedure is not disturbed by complicated constituent member of the transfer unit.

As mentioned herein, the invention can form images of all colors at the same image forming position without using transfer drum of complicated constitution, and hence the colors are matched accurately in a simple structure. The image forming units are independent in each color, and can be easily replaced in each color, so that the maintenance is easy. In this constitution, moreover, each image forming unit containing the photosensitive, member can be adjusted independently outside, the user can replace without making adjustment if the unit is adjusted before shipping.

The photosensitive member is always covered except when forming the image, and the photosensitive member will not be damaged or contaminated, and the inside of the apparatus will not be contaminated by the scattering developer.

Also in the constitution of the invention, the image forming unit is an integrated structure comprising photosensitive member, developing device and toner hopper, and hence the mechanism for replenishing with toner is simple. Still more, the toner will not spill over at the time of replenishment, and the inside of the machine is hardly contaminated by the toner.

Further in this constitution, also when forming color images continuously, each photosensitive member is stopped while other colors are being formed, and therefore a stable image is obtained without electrostatic fatigue.

The constitution of the invention is designed so that the toner in the toner hopper is stirred spontaneously by making use of the rotary motion of the image forming unit. When the unit is positioned at the image forming position, the toner is spontaneously collected in the toner feed unit in the hopper, and any special stirring mechanism is not needed in the toner hopper. Accordingly, the structure of the image forming unit can be simplified. If the toner remainder in the hopper runs short, the toner is fed smoothly.

In the constitution of the invention, if the fluidity of the toner is lowered when exposed to environments of high temperature and high humidity for a long time, by rotating the entire image forming unit group, the toner in each image forming unit is stirred sufficiently, so that deterioration of photosensitive member and toner can be prevented, and moreover the solidified toner is loosened and background formation on the image can be prevented.

Generally, in order to avoid disturbance of toner image on the transfer member due to contact between the photosensitive member and the transfer member, while the toner image on the transfer member is passing the transfer position, the photosensitive member and the transfer member are spaced from each other by a certain mechanism. Or, when contacting with the photosensitive member, an electric field is applied to prevent from reverse transferring from the transfer member. In these methods, however, complicated mechanism or expensive power source is needed, and the sequence is complicated. By contrast, in the constitution of the invention, contact between the transfer member and image forming unit can be prevented by making use of the rotary move of the image forming unit group, and the complication of the apparatus can be avoided. According to the constitution of the invention, when the toner image formed on the transfer member passes the toner image transfer position, the photosensitive member of the image forming unit is not at the image forming position, and therefore the toner image on the transfer member and the image forming unit do not contact, so that the toner image on the transfer member will not be disturbed.

Upon start or end of the rotary move of the image forming unit, a temporary speed difference occurs between the photosensitive member and the transfer member. In the conventional method, the toner image was disturbed in the toner image formed area. In the invention, however, this move is done in the area where toner image is not formed, and therefore the toner image will not be disturbed.

In other constitution of the invention, the peripheral length of the transfer member is set longer than the maximum image length, and a short region of non-image part is formed on the transfer member, and this region is utilized for exchanging the image forming units. In this constitution, right after transfer of toner image of the first color, when the non-image region of the transfer member passes the transfer position, the photosensitive member of the image forming unit of the first color is separated from the transfer member. While the image region of the transfer member is passing the transfer position, the image forming unit group is moved by rotation. When the transfer member makes one revolution and the non-image region reaches again the transfer position, the photosensitive member of the image forming unit of the second color is brought in contact with the transfer member, and the rotary move of the image forming unit is completed. In this method, the non-image region on the transfer member is not needed to be long, and the peripheral length of the transfer member may be short, so that the apparatus may be reduced in size. Furthermore, by interrupting the rotary move of the image forming unit group, the timing of the rotary move of the image forming unit group can be controlled to match with the front end position of the toner image on the transfer member. Hence, image positioning is easy and accurate.

Concerning the embodiment of the invention, further improved examples of the color electrophotographic apparatus are described more specifically below while referring to the accompanying drawings.

PREFERRED EMBODIMENT 1

The embodiment of the invention is described with reference to the drawings.

Figure 6:
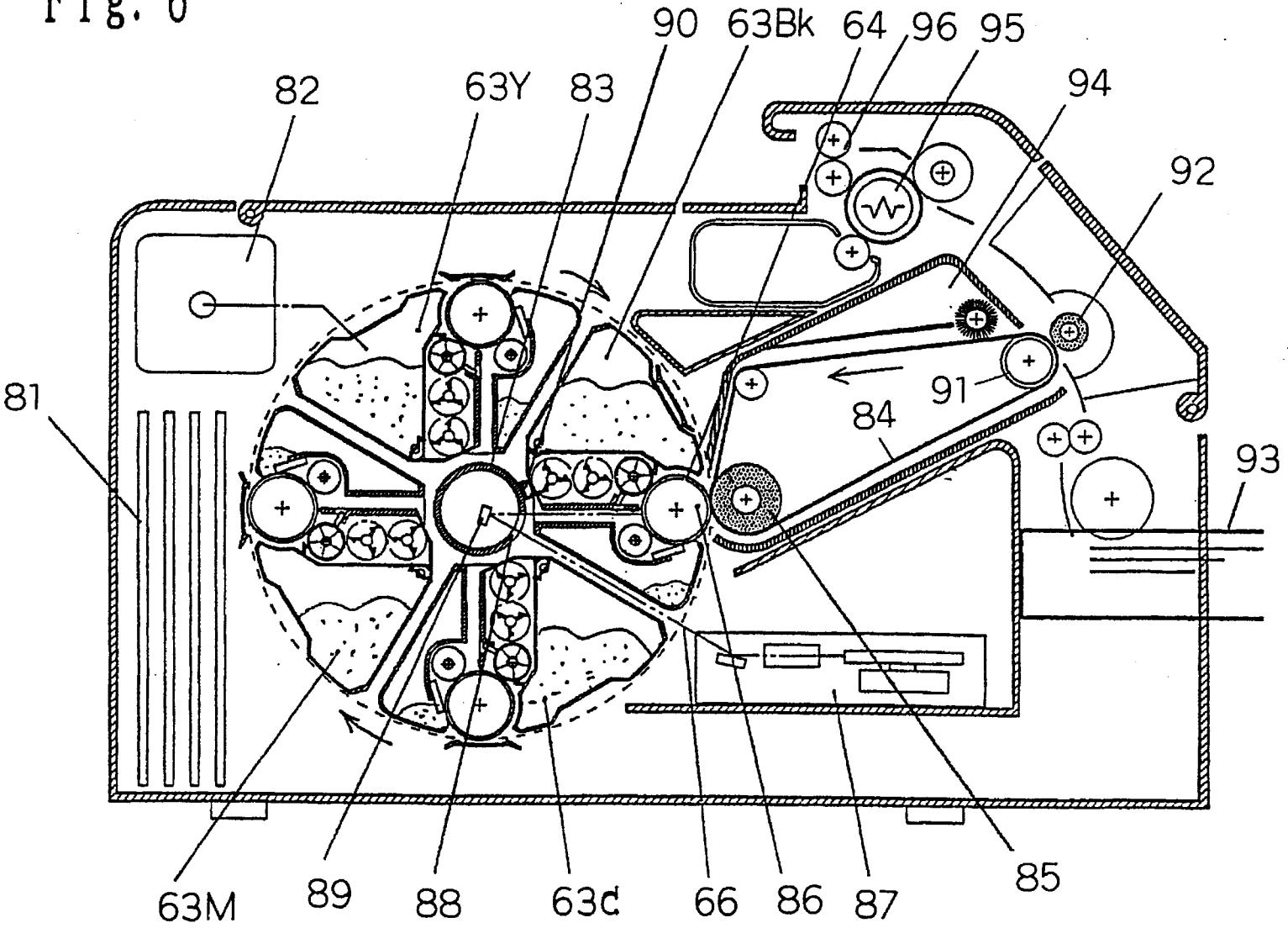
FIG. 6 is structural diagram of a color electrophotographic apparatus in a first embodiment of the invention.

FIG. 6 is a general structural diagram of a color electrophotographic apparatus of the invention. What differs from the apparatus in FIG. 3 is the constitution of the image forming unit and intermediate transfer belt unit.

Figure 7:
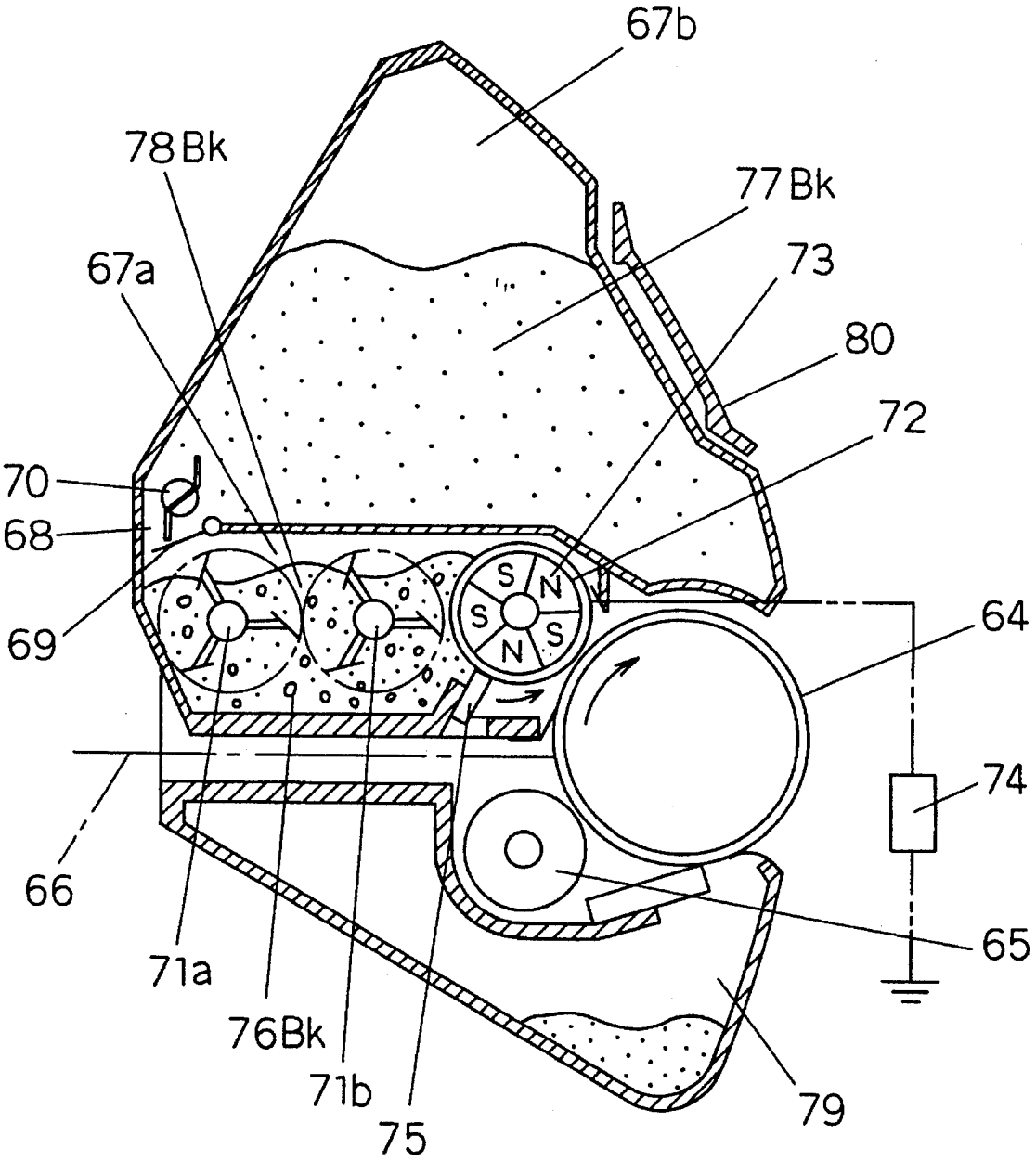
FIG. 7 is a structural diagram of an image forming unit used in the color electrophotographic apparatus in the first embodiment of the invention.

In the center, four sector-shaped image forming units 63Bk, 63Y, 63M, and 63C for black, yellow, magenta and cyan are disposed in an annular form to compose the image forming unit group. The image forming units are composed of same members except for the developer contained inside, and the image forming unit for black is described for simplification of explanation, and units for other colors are omitted. For individual colors, same parts are given by same reference numerals, and color codes are attached if necessary to distinguish by color. FIG. 7 shows the detail of the image forming unit 63Bk for black.

In FIG. 7, reference numeral 64 denotes an organic photosensitive member having phthalocyanine dispersed in polycarbonate binder resin, 65 is a charging roller for charging the photosensitive member electrically in the negative polarity, 66 is a signal light by laser beam, 67*a* is a first hopper containing a developer mixing carrier and toner, 67*b* is a second hopper containing toner only, 68 is an opening opened for toner refill, 69 is a lid for opening and closing the opening 68, 70 is an agitator for toner refill, and 71*a*, 71*b* are agitators for conveying the developer in the first hopper 67*a* into the developing section.

Reference numeral 72 is a rotatable electrode roller made of aluminum, 73 is a magnet fixed coaxially therein so as not to rotate, 74 is an alternating-current high voltage power source for applying a voltage to the electrode roller 72, and 75 is a magnetic blade for defining the toner layer thickness on the electrode roller 72. The photosensitive member 64 is 30 mm in diameter, and is rotated in the arrow direction at a peripheral speed of 60 mm/s, and the electrode roller 72 is 16 mm in diameter, and is rotated in the arrow direction at a peripheral speed of 60 mm/s.

The first hopper 67*a* contains two-component developer 78Bk mixing toner 77Bk and ferrite carrier 76Bk of 50 μm in particle size having the surface coated with silicone resin, and it is adhered to the surface of the photosensitive member 64 by magnetic force. The toner to be used is prepared by dispersing pigment or the like in the polyester resin, and further adding additives.

In the second hopper 67*b*, 400 g of toner is enclosed and contained at the time of assembly of the image forming unit, and about 5,000 sheets of A4 size of monochromatic 5% equivalent original can be produced without refill of toner from outside the unit. When the second hopper 67*b* runs out of the toner, the user replaces the image forming unit.

Reference numeral 79 is a cleaner for removing the toner left over on the surface of the photosensitive member after transfer. Reference numeral 80 is a photosensitive member cover for protecting the photosensitive member 74, and it is shown in open state for forming an image in FIG. 7. This photosensitive member cover 80 covers the photosensitive member when the image forming unit is at other position than image forming position to prevent contamination of the photosensitive member or contamination of the inside of the machine by the toner when the unit moves by rotation.

Referring back to FIG. 6, the constitution of the printer unit is described.

Image forming units 63Bk, 63Y, 63M, 63C disposed in an annular form are supported by a support (not shown), and are, on the whole, driven by a driving motor 82 which is moving means controlled by a control circuit 81, and are rotatable in the arrow direction about a cylindrical shaft 83 which is fixed so as not to rotate. The image forming units are sequentially moved and positioned to an image forming position 86 confronting a first transfer roller 85 for supporting an intermediate transfer belt 84 described later. The image forming position is also the exposure position by signal light 66. The support of the image forming units 63Bk, 63Y, 63M, 63C is provided with means (not shown) for detecting that each image forming unit has moved to the image forming position 86, and every time the move of each unit is over, a signal corresponding to the end of move is transmitted to the control circuit 81.

Reference numeral 87 is a laser exposure device, which generates signal light 66 by laser beam modulated by a signal entering the printer unit. It passes through the optical path composed in a sector-shaped space between the image forming units 63Bk and 63C in FIG. 6, passes through a transparent window 88 opened in part of the shaft 83, enters a mirror 89 fixed inside the shaft 83, and is reflected and emitted to the photosensitive member 64 of the image forming unit at the image forming position 86, thereby forming a latent image. In the state in FIG. 6, it acts on the image forming unit 63Bk for black.

Reference numeral 90 denotes a toner concentration sensor of magnetic resistance system installed in the shaft 83. It is positioned to detect the toner concentration in the first hopper 67*a* of the image forming unit when the image forming unit is positioned at the image forming position 86. The side wall of the image forming unit in the area corresponding to the position of the toner concentration sensor 90 is thin in wall thickness so as to detect the toner concentration stably. Stable detection is realized by smooth, thin and strong member to be used in the side wall of the unit corresponding to the sensor. In this embodiment, the toner concentration sensor 90 is fixed, but it is also possible to use a mechanism for spacing the position of the toner concentration sensor 90 from the image forming unit when rotating the image forming unit group. In this embodiment, moreover, the toner concentration sensor 90 is of magnetic resistance system, but other sensors such as optical reflection concentration sensor capable of detecting the toner concentration can be used.

In the constitution of the invention, one toner concentration sensor is used in four image forming units, and therefore the constitution of each image forming unit is simple and the cost is saved.

Reference numeral 84 is an intermediate transfer belt, which is made of a film of semiconductive urethane in an endless belt form of 100 m in thickness, and is movable in the arrow direction, being wound on a first transfer roller 85 forming a low resistance treated urethane foam on the circumference, and a second transfer roller 91 made of stainless steel.

The first-transfer roller 85 contacts with the photosensitive member 64 of the unit 63Bk at the image forming position through the intermediate transfer belt 84. The second transfer roller 91 contacts with a third transfer roller 92 in a same constitution as the first roller 85 through the intermediate transfer belt 84 so as to be driven and rotated. In the nip area between the intermediate transfer belt 84 and third transfer roller 92, a paper conveying route is formed so that the paper may be sent from a paper feed unit 93. Reference numeral 94 is a belt cleaner unit comprising a belt cleaner for cleaning the intermediate transfer belt. Reference numeral 95 is a fixing device for fixing the toner image on the paper after transfer, and 96 is a discharge roller for discharging the paper after fixing. This is the description of the principal constitution of the electrophotographic apparatus and image forming unit of the invention.

The operation of this apparatus in color image forming mode is described below.

Figure 8:
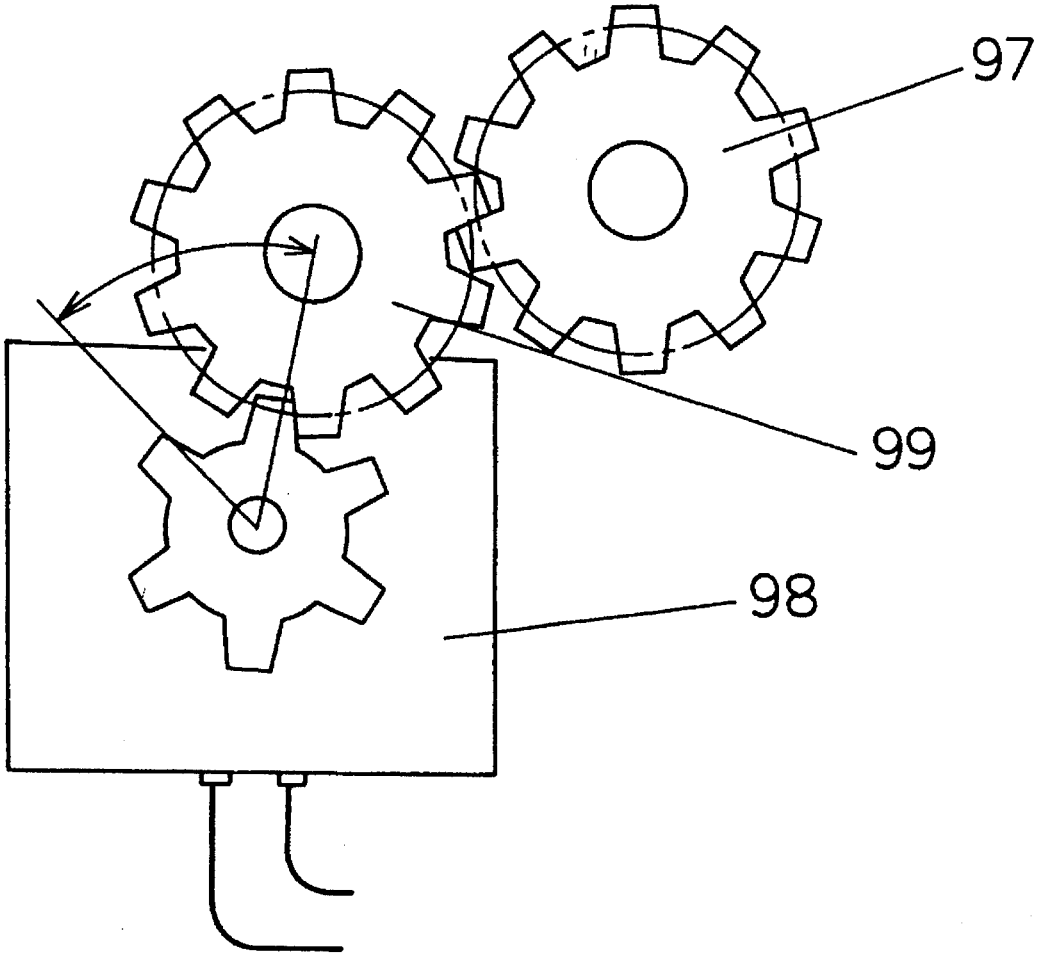
FIG. 8 is a structural diagram for explaining transmission of drive of the toner supply unit in the first embodiment of the invention.

First, each image forming unit is at the position shown in FIG. 6. The black image forming unit 63Bk is positioned at the image forming position 86, and the toner concentration sensor 90 contacts with the side wall of the image forming unit. The image forming position 86 is also the position confronting the first transfer roller 85. The operation of the image forming unit is started, black signal light from the laser exposure device 87 enters the image forming unit 63Bk, and an image is formed by black toner. Simultaneously with start of image formation, the toner concentration sensor 90 starts to detect toner concentration of the developer in the first hopper 67*a*, and the toner is supplied depending on the detection signal. FIG. 8 shows the drive unit of toner refill agitator 70 of the unit in image forming process. Reference numeral 97 is a gear for rotating the agitator 70 in FIG. 7, 98 is a motor for driving the gear 97, being disposed at the printer main body side, and 99 is a gear for transmitting the drive of the motor 98 to the gear 97. When supplying the toner depending on the output of the toner concentration sensor 90, the motor 98 rotates, and the driving force is transmitted to the agitator 70 through the gear 99 and gear 97, and the agitator 70 is put in rotation to feed the toner in the second hopper 67*b* into the first hopper 67*a*. During rotary motion of the image forming unit group, the gear 99 is spaced from the gear 97, and when the move of the unit group is over, they are connected again. In this embodiment, the toner refill motor is newly installed at the main body side, but the drive may be transmitted from other driving means provided at the main body side for other purpose, such as the motor for driving the photosensitive member. In such a case, when clutch or drive disconnecting means is provided for transmitting the drive, the drive of the agitator 70 may be easily controlled. In this constitution, toner refilling is driven by the printer main body, not inside the image forming unit, and the image forming unit does not require complicated mechanism for supplying the toner, and the constitution is simple.

As shown in FIG. 7, the lid 69 in the image forming unit is rotatably fixed by hinge at one side so as to open only when a force is applied from the second hopper 67*b* side. When force is not applied, the opening 68 is closed by a spring (not shown). The agitator 70 is designed to push open the lid 69 while stirring the surrounding toner, and supply the toner. In this constitution, the toner is supplied depending on the signal from the toner concentration sensor 90. Actually, the toner concentration detection is started 3 seconds after start of image formation in order to allow the sensor output to be stabilized. While toner is not supplied, the agitator 70 stops at a position not to push to open the lid 69. Except when the image forming unit is forming an image, especially when the image forming unit is not at other position than the image forming position, the lid 69 is locked in closed state by the lock mechanism (not shown) installed in the support (not shown) of the image forming unit, thereby preventing mixing of the toner from the second hopper into the first hopper except when supplying toner.

In thus constituted image forming unit, the operation is described below by reference to FIG. 7. The photosensitive member 64 was charged at −700 V by the charging roller 65. Signal light 66 from the laser beam was emitted to this photosensitive member 64 to form an electrostatic latent image. At this time, the exposure potential of the photosensitive member was −100 V.

The surface of the photosensitive member 64 passed before the electrode roller 72 rotating at a double peripheral speed in the same direction as the photosensitive member 64, bearing the two-component developer 78Bk. At this time, when the uncharged region of the photosensitive member 64 passed, an alternating-current voltage (frequency 1.5 kHz) of 750- V 0-p (peak to peak 1.5 kV) superposing a direct-current voltage of −400 V was applied to the electrode roller 72 from the alternating-current high voltage power source 74. As a result, a toner image negative-positive inverted only in the image area was left over on the photosensitive member 64. The developer 72Bk supported on the electrode roller 72 was returned into the first hopper 67*a*, and used in next image forming. In this way, a black toner image was obtained on the photosensitive member 64. The developing units 63Y, 63M, 63C for other colors than black are similarly constituted, operate in the same manner.

Back to FIG. 6, the image forming speed (equal to the peripheral speed of the photosensitive member) of the image forming unit 63Bk, and the moving speed of the intermediate transfer belt are set equal. Simultaneously with image forming, by the action of the first transfer roller 85, the black toner image is transferred on the intermediate transfer belt 84. The image forming units 63Bk, 63Y, 63M, 63C are driven on the whole by the driving motor 82, and rotated and moved in the arrow direction in FIG. 6 in assembly. Rotating exactly 90 degrees, when the image forming unit Y reaches the image forming position 86, they are stopped and the image forming unit Y is positioned. Since the other parts than the photosensitive member of the image forming unit are positioned inside of the rotation circle (broken line arc in FIG. 6) at the front end of the photosensitive member, the intermediate transfer belt will not touch the image forming unit. Same as before, the laser exposure device 87 feeds this time a yellow signal light into the image forming unit 63Y, and a yellow toner image is formed and transferred. At this time, the writing timing of the yellow signal light is controlled so that the previously transferred black toner image and the next yellow toner image may be matched in position on the intermediate transfer belt 84. In this period, the third transfer roller 92 and cleaner unit 94 are spaced from the intermediate transfer belt 84, and hence do not act on the toner image above.

The same action is done for magenta and cyan, and toner images of four colors are overlaid on the intermediate transfer belt, and a color image is formed. After transfer of the final cyan toner image, the toner images of four colors are transferred in batch on the paper sent from the paper feed unit 93 by adjusting the timing, by the action of the third transfer roller 92. The toner image transferred on the paper is fixed by the fixing device 95. The paper is then discharged out of the apparatus through the discharge roller 96. The remaining toner after transfer left over on the intermediate transfer belt is cleaned by the action of the cleaner unit 94, and is ready for next image forming.

PREFERRED EMBODIMENT 2

Figure 1:
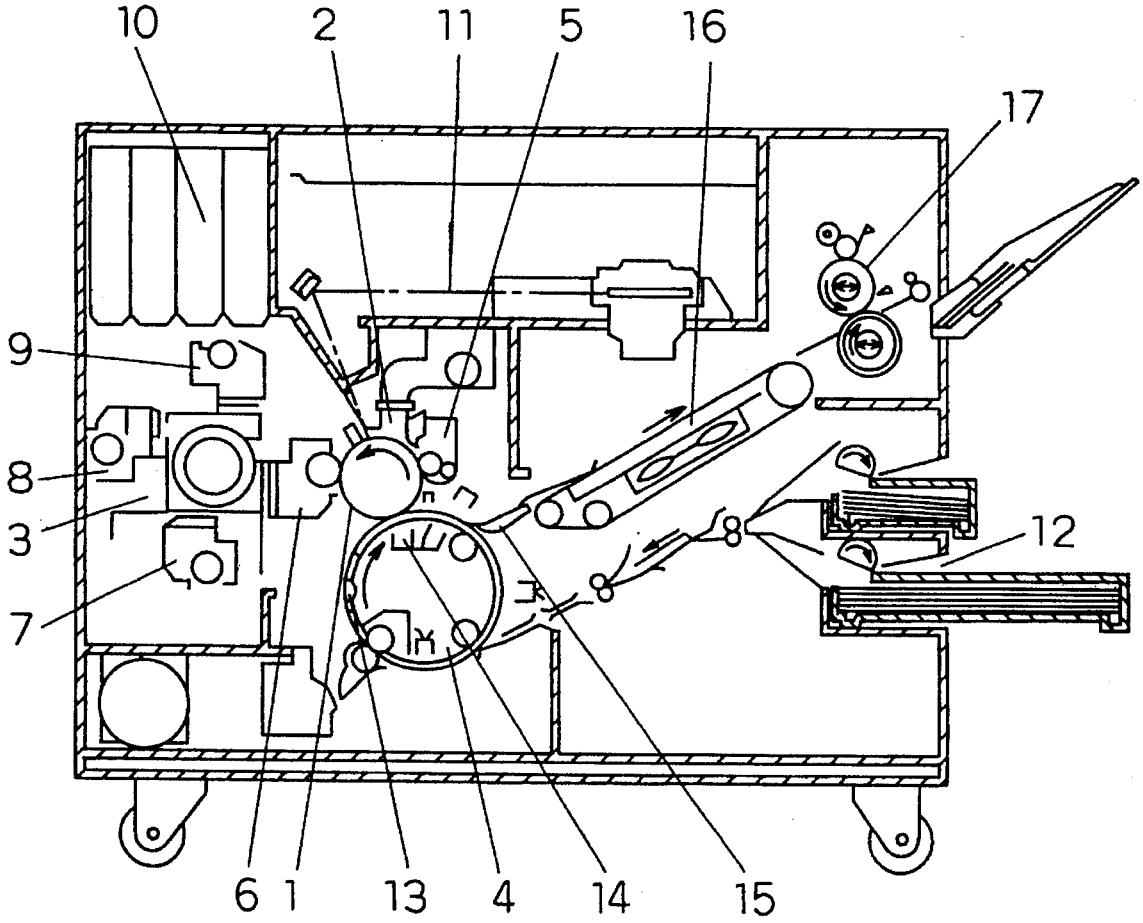
Fig. 1 (PRIOR ART)
FIG. 1 is a structural diagram of a conventional color electrophotographic apparatus.
Figure 2:
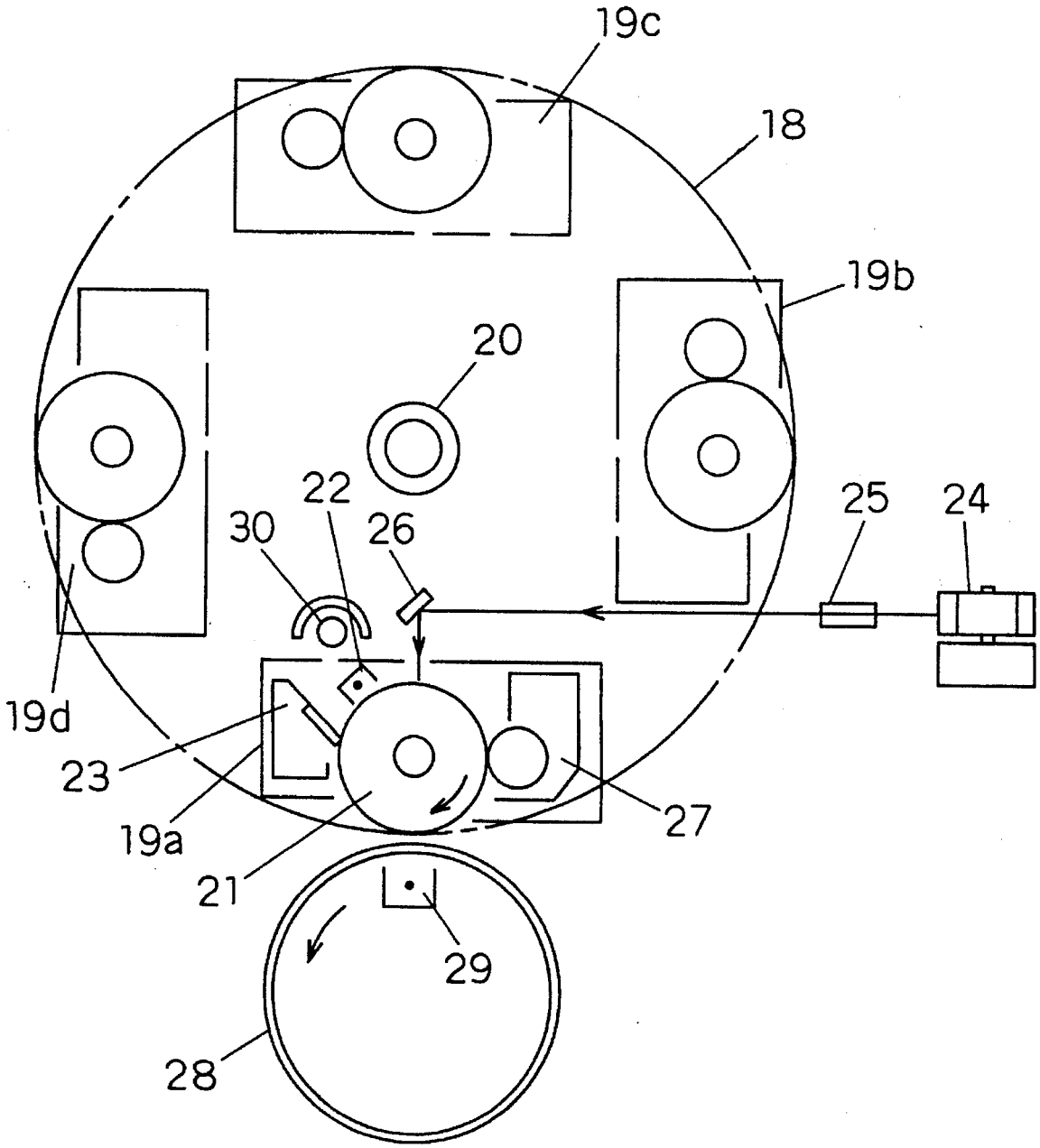
Fig. 2 (PRIOR ART)
FIG. 2 is a structural diagram of a conventional color electrophotographic apparatus.
Figure 9:
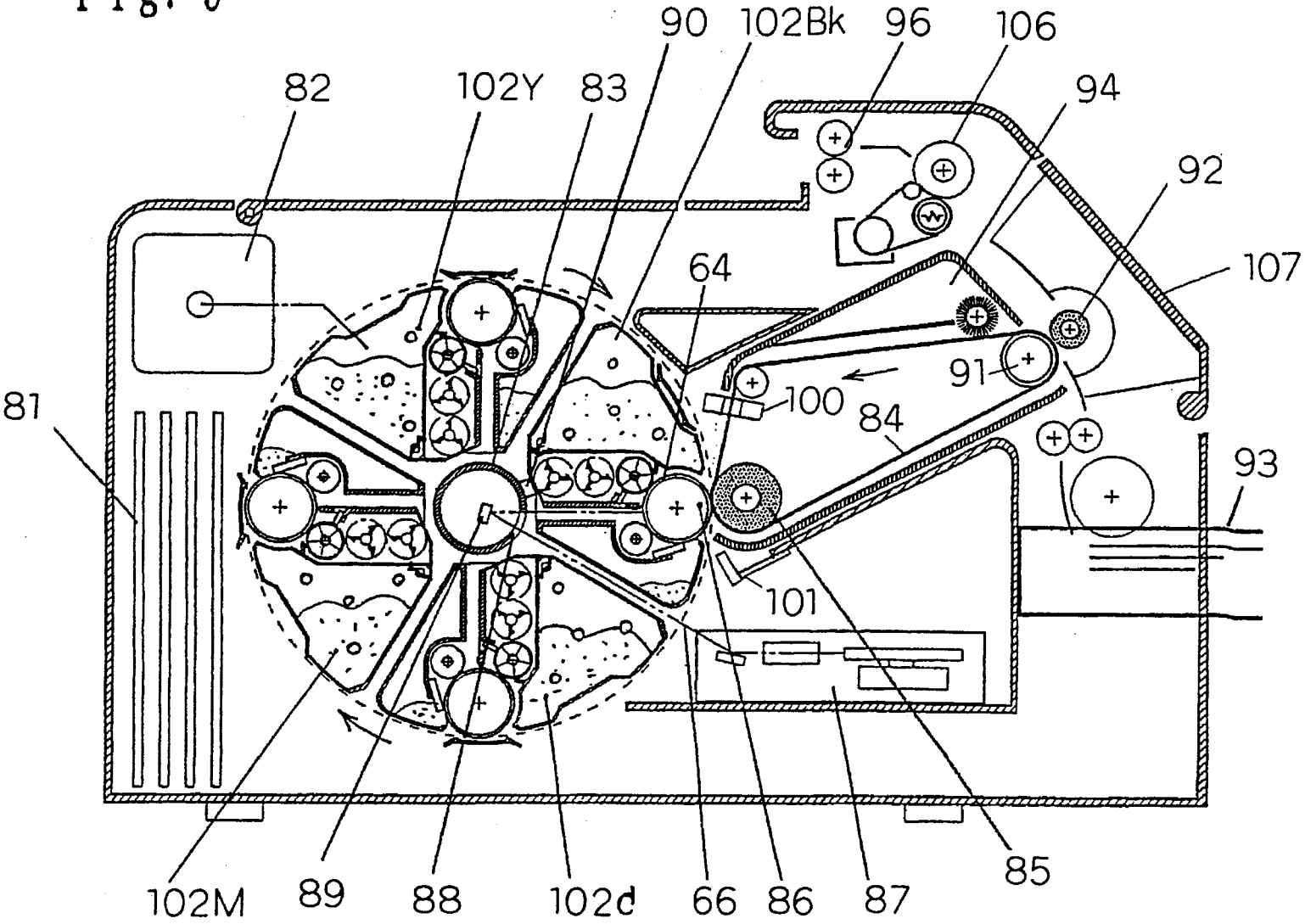
FIG. 9 is structural diagram of a color electrophotographic apparatus in second to fourth embodiments of the invention.

A color electrophotographic apparatus of the invention is described below while referring to FIG. 9. Between the apparatus in FIG. 9 and the apparatus in FIG. 6, the image forming units, intermediate transfer belt unit, and erase lamp of photosensitive member are different. The image forming units are improved in the constitution for preventing coagulation of toner in the toner hopper. The intermediate transfer belt unit is provided with a position detector 100. An erase lamp 101 is provided at the downstream side of the transfer position of the photosensitive member 64. The erase lamp 101 is an LED (wavelength 660 nm), and is positioned near the image forming position 86, and it illuminates the surface of the photosensitive member 64 after toner image transfer during image forming process, and discharges the surface charge left over on the photosensitive member 64. In FIG. 9, constituent elements common to the apparatus in FIG. 6 are identified with same reference numerals. Thus, by installing one destaticizing means of the photosensitive member at the main body side near the image forming position, outside the image forming unit group, the constitution of the apparatus is simplified. Besides, when photo-discharging means such as light-emitting diode and lamp is used as the erase means, invasion of strayed light into the signal light optical path may be decreased as compared with the case of installing the erase lamp at the rotation center side of the image forming unit group in the prior art as shown in FIG. 2. Furthermore, without temperature rise of the rotation central parts of the image forming unit group by the lamp, a stable and favorable color image can be produced.

In the center of FIG. 9, four sets of sector-shaped image forming units 102Bk, 102Y, 102M, 102C for black, yellow, magenta and cyan are disposed in an annular form to compose the image forming unit group.

Figure 10:
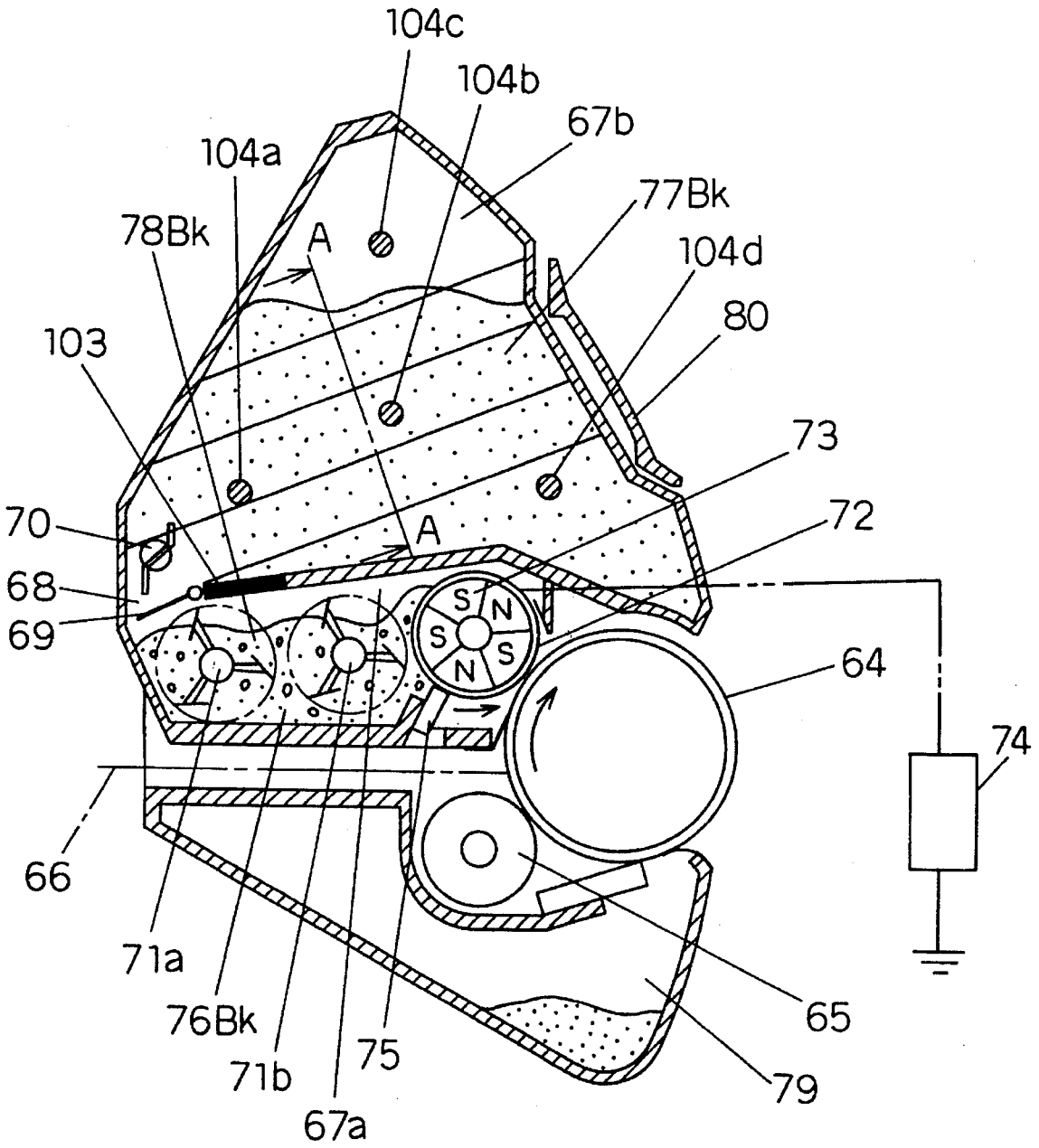
FIG. 10 is a structural diagram of an image forming unit used in the color electrophotographic apparatus in the second to fourth embodiments of the invention.

FIG. 10 shows the detail of the image forming unit 102Bk for black. Reference numeral 103 is a toner remainder sensor for detecting the remainder of the toner in the second hopper 67*b*. Reference numerals 104*a*, 104*b*, 104*c*, 104*d* are stainless steel cylindrical members of 2 mm in diameter provided in the longitudinal direction in the second hopper 67*b*, and are fixed to the side of the unit on both ends.

Figure 11:
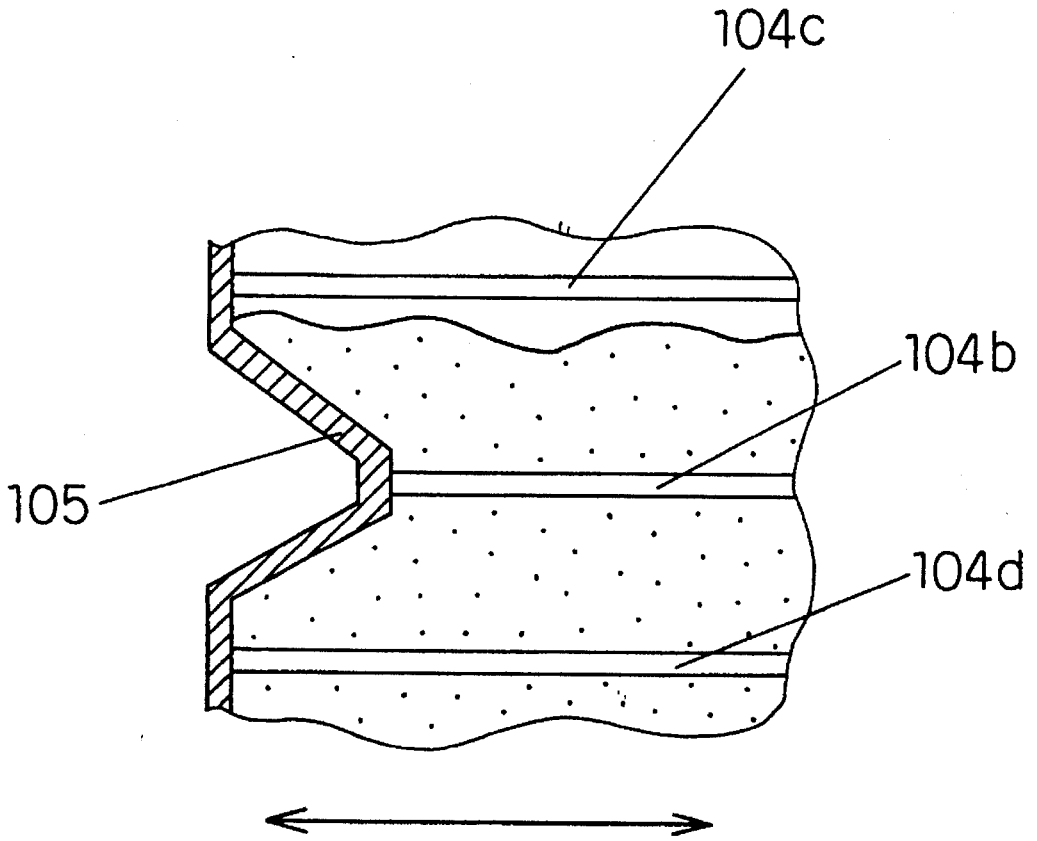
FIG. 11 is a sectional view of a hopper of an image forming unit used in a color electrophotographic apparatus in an embodiment of the invention.

FIG. 11 is a sectional view as seen from the arrow direction of section AA of FIG. 10. Reference numeral 105 is a side wall of the second hopper 67*b* of the image forming unit, and is in a projected shape having a slope at the hopper inner wall side as shown in the drawing. Only one side of the inner wall is shown in FIG. 11, but the other side wall confronting the side wall 105 is similarly projected to the inside of the unit. When the image forming unit rotates in the apparatus in FIG. 9, the toner in the second hopper 67*b* hits against the cylindrical members 104*a*, 104*b*, 104*c*, 104*d*, and gets loose. Besides, by the slope of the inner wall 105 it receives force laterally and longitudinally, and hence coagulation of the toner is prevented. In this embodiment, stainless steel cylindrical members are used as the members for stirring the toner, but other members may be used, such as ABS resin and similar triboelectrically charging members.

In the invention, the inner wall of the image forming unit is inclined in the direction of axis of rotation. As a result, when the image forming unit group moves by rotation, the toner in the unit receives force in the direction of axis of rotation, and reciprocates in the axial direction in the hopper. Thus, without using screw or other complicated mechanism for agitating and reciprocating the toner in the hopper, the toner can be agitated and reciprocated. Besides, by the cylindrical members fixed in the direction of axis of rotation of the unit side wall provided in the image forming unit, the toner gets loose in the rotary move. It does not require, hence, shaking of the unit by dismounting from the apparatus, or provision of complicated agitation mechanism.

Referring back to FIG. 9, the constitution of the printer unit is described. The image forming units 102Bk, 102Y, 102M, 102C disposed in an annular form are supported by a support (not shown), and, on the whole, are driven by a moving motor 82 which is driving means controlled by a control circuit 81, and are rotatable in the arrow direction about a cylindrical shaft 83 which is fixed and does not rotate. Reference numeral 106 is a fixing device for fixing the toner image on the paper after transfer, and 96 is a discharge roller for discharging the paper after fixing.

Figure 12:
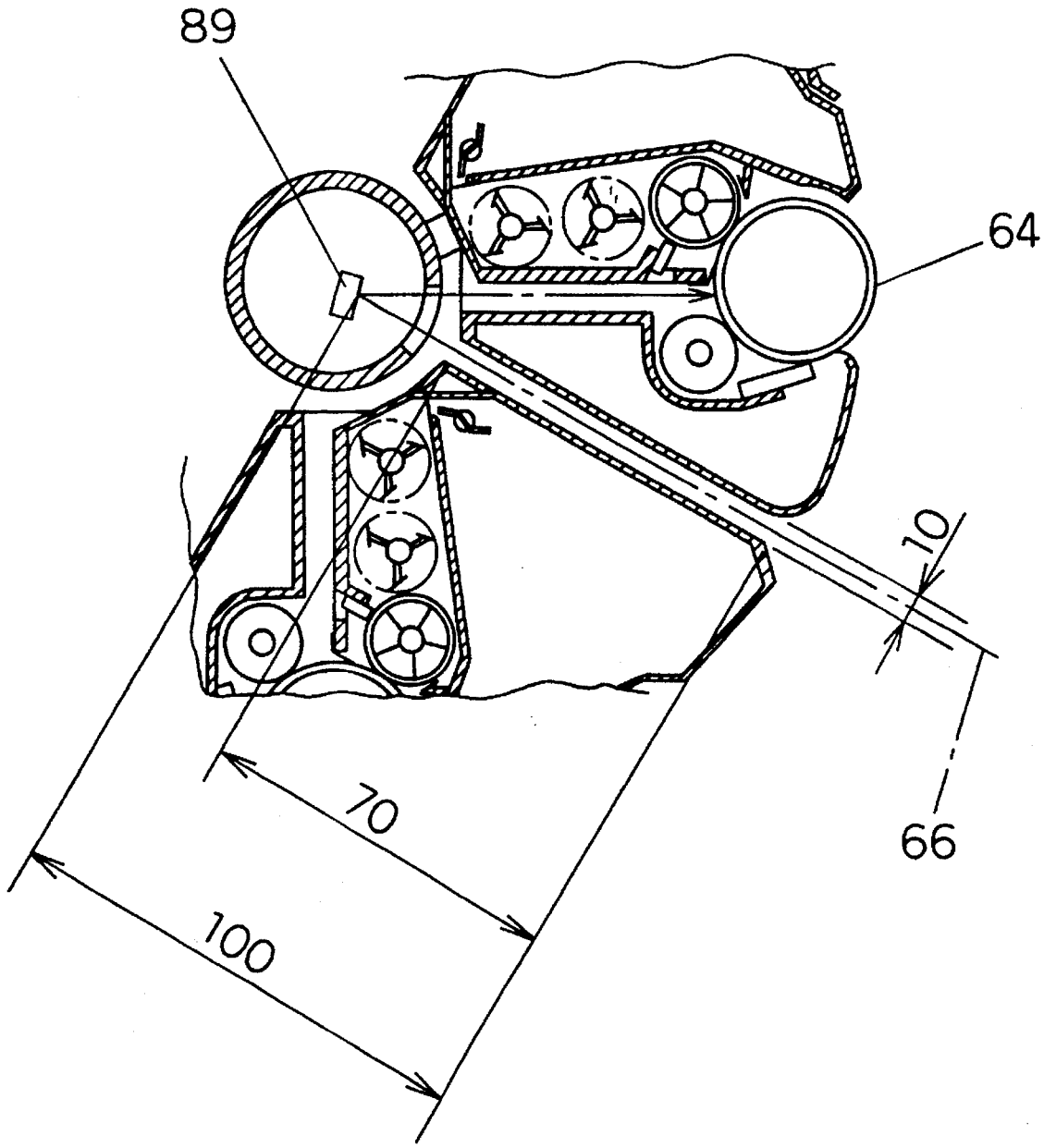
FIG. 12 is a structural diagram of an optical path of signal light composed of an image forming unit of a color electrophotographic apparatus in an embodiment of the invention.

FIG. 12 is a magnified view of optical path composed of two adjacent image forming units. Herein, the optical path up to the mirror 89 is composed of mutually parallel outside planes of two adjacent sector-shaped image forming units, and the width of the optical path composed of end faces of unit is 10 mm, the length of the optical path is 70 mm, and the optical path length from the unit outer periphery to the mirror is 100 mm. Herein, the wall surface parallel to the scanning plane of the signal light is composed of the side wall of the image forming unit, and the wall vertical to the scanning plane (the optical path side wall in the longitudinal direction in the drawing) is composed of image forming unit support, so that invasion of strayed light from the unit rotary move side may be decreased.

The operation of this apparatus in color image forming is same as in Preferred Embodiment 1, and is hence omitted, and the effects of toner remainder detection and toner coagulation prevention in the second hopper 67*b* are described below.

The black signal light from the laser exposure device 87 is entered into the image forming unit 102Bk, and the operation of the image forming unit is started, and an image is formed by black toner. Simultaneously with start of image forming, the toner concentration sensor 90 begins to detect the toner concentration in the second hopper 67*b*, while the toner remainder sensor 103 detects the remainder of the toner in the second hopper 67*b*. As the toner is spent during development, when the remainder in the second hopper 67*b* runs short, the toner remainder sensor 103 issues a first toner shortage signal to the control circuit 81. Receiving the signal, the control circuit 81 stores the signal until the image forming action is over, and after finishing of the image forming action, it sends a signal to the driving motor 82 to rotate the image forming unit group. In the case of a monochromatic output, the image forming unit completely spending the toner is positioned at the image forming position 86 when the image forming action is finished. In such a case, the control circuit 81 instructs the driving motor 82 to move the image forming unit group by one revolution. When the toner-depleted image forming unit finishes the image forming action, it is located at other position than the image forming position 86, for example, at the image forming unit 102M in FIG. 9, the control circuit 81 instructs the driving motor 82 to rotate another half revolution after rotating the image forming unit group by one revolution so that the toner-less image forming unit may be located at the image forming position 86. The image forming unit returning to the image forming position 86 by the driving motor 82 is detected again by the toner remainder sensor 103, and the toner remainder in the second hopper 67*b* is detected. If the result is no remaining toner again, the control circuit 81 instructs to exchange the corresponding image forming unit. If the result of the second detection of the toner remainder is toner remainder available, different from the first time, the control circuit 81 judges that there is toner in the hopper 67*b*, and instructs to continue normal image output.

The initializing action of the apparatus of the invention and the operation in color image forming are described below.

When the power source of the apparatus is turned on, the fixing device 106 starts to heat up. During the period of heat-up, the image forming unit group at the position in FIG. 9 begins to rotate in the arrow direction. At this time, each image forming unit passes through the image forming position 86, neither stopping at the image forming position 86 nor initializing. When the image forming unit group turns one revolution exactly, the image forming unit group stops its rotary move. When the temperature of the fixing device 106 reaches a specified temperature, the image forming unit group starts to rotate again in the arrow direction in FIG. 9. Each image forming unit starting to rotate again sequentially passes the image forming position 86 same as above. This time, different from above, each image forming unit stops once at the image forming position 86, and is initialized. The initializing action is done without exposing the same action as the image forming action. Thus, all image forming units are initialized, and when the image forming unit group returns to the initial position, the rotary move is terminated, and the apparatus is ready for start of image forming action.

If the apparatus is stopped due to paper jam occurring during image forming action, the operator opens the front cover 107 of the apparatus according to the display, and repairs, and closes the front cover 107. Then, the apparatus positions each image forming unit at the image forming position 86 sequentially, and initializes. At this time, if the temperature of the fixing device 106 is lower than the mean operating temperature about 200 deg. C.) by more than 100 deg. C., the control circuit 81 judges that it has passed a long time since the apparatus was stopped, and rotates the image forming unit group by one revolution, same as when turning on the power source, and initializes.

When the power source turned on, if passing more than three hours without image forming action or initializing action, the control circuit 81 instructs the driving motor 82, and rotates the image forming unit group. This is a rotary move for preventing the toner in the hopper from coagulating, and initializing is not done at this time, too.

In this constitution, by making use of the rotary move of the image forming unit group, the toner in the toner hopper is agitated and reciprocated, so that the toner may be agitated sufficiently in a simple constitution, without requiring complicated mechanism.

In the constitution of the invention, if the toner is lightly coagulated in the image forming unit being let stand for a long time, the toner is agitated and loosened only by rotating the image forming unit group.

Also in the constitution, by agitation by rotary move of the image forming unit group, and agitation and reciprocal move of the toner in the toner hopper by making use of the shape of the side wall of the unit, coagulation of the toner can be prevented in a simple constitution without requiring complicated mechanism.

If the toner remainder sensor makes a wrong detection of no toner because of coagulation of the toner, when the toner remainder is detected again after loosening the toner by rotating the image forming unit group, such detection error can be prevented.

PREFERRED EMBODIMENT 3

Referring also to FIG. 9, in this embodiment, the positioning method of the image forming unit and intermediate transfer belt is different. It is set so that the image forming speed of the image forming unit 102Bk (equal to the peripheral speed of the photosensitive member) and the moving speed of the intermediate transfer belt be equal to each other. When the image is formed, by the simultaneous action of the first transfer roller 85, the black toner image is transferred on the intermediate transfer belt 84. When the transfer of the black toner image is finished, the driving motor 82 starts rotary move of the image forming unit group before the front end of the black toner image on the intermediate transfer belt 84 reaches the transfer position. Afterwards, while the black toner image on the transfer belt 84 is passing the transfer position, the image forming unit group is rotated by the driving motor 82 by 70 degrees in the arrow direction in FIG. 9, and stops once.

Afterwards, the position detection sensor 100 detects the rear end of the black toner image on the intermediate transfer belt 84, and sends the passing signal of the image rear end to the control circuit 81. The control circuit 81, depending on the signal, instructs the driving motor 82 in stopped state to move again. The image forming unit group resumes its motion, and moves the image forming unit 102Y to the image forming position 86 after the black toner image rear end on the intermediate transfer belt 84 passes the transfer position, and finishes the rotary move. The image forming unit 102Y starts rotation of the photosensitive member and electrode roller simultaneously with completion of the move. Next, the position detection sensor 100 detects the front end of the black toner image on the intermediate transfer belt 84, and sends the passing signal of the image front end to the control circuit 81. The control circuit 81, depending on this signal, instructs the laser exposure device 87 to start exposure at the timing of matching the front end of the yellow toner image with the front end of the black toner image on the intermediate transfer belt 84, and starts formation of yellow image. Receiving the instruction, the laser exposure device 87 feeds signal light into the image forming unit 102Y by the yellow signal, this time, same as above, so that a yellow toner image is formed and transferred.

The same action is done for magenta and cyan, and toner images of four colors are overlaid in position on the intermediate transfer belt, and a color image is formed. After the transfer of the final cyan toner image, the toner images of four colors are transferred at once batch by the action of the third transfer roller 92, on the paper sent from the paper feed unit 93, by matching in timing. The toner image transferred on the paper is fixed by the fixing device 106. The paper is then discharged out of the apparatus through the discharge roller 96.

This ends the description of the constitution and operation of the embodiments.

What is claimed is:

1. A color electrophotographic apparatus comprising:

an image forming unit group containing a plurality of image forming units, each image forming unit comprising a photosensitive member, and developing means having a toner of different color than others and forming a toner image on the photosensitive member, a movable transfer member on which the toner image on the photosensitive member is overlaid and transferred at a transfer position, and a color image is formed, driving means for driving by selecting as a moving speed of the transfer member, a first running speed used when forming an image or a second running speed slower than the first running speed, said second running speed including a stopping state of the transfer member, exposure means for exposing the image at an exposure position, said exposure position being a specific distance from the transfer position, and moving means for moving the image forming unit group to sequentially position each image forming unit at an image forming position defining said exposure position and transfer position, wherein the transfer member is driven at the second running speed while the image forming unit group is moving.

2. A color electrophotographic apparatus comprising:

an image forming unit group containing a plurality of image forming units, each image forming unit comprising a rotatable photosensitive member, and developing means having a toner of different color than others and forming a toner image on the photosensitive member, a rotatable transfer member on which the toner image on the photosensitive member is overlaid and transferred, and a color image is formed, position detecting means for detecting a specific position on the transfer member, transfer means for transferring the toner image on the photosensitive member to the transfer member at a transfer position, exposure means for exposing the image at an exposure position, said exposure position being a specific distance from the transfer position, and moving means for moving the image forming unit group to sequentially position each image forming unit at an image forming position defining said exposure position and transfer position, wherein a peripheral length on the transfer member surface, on the basis of the rotating direction of the transfer member, is longer than a sum of the length of the image region on the transfer member, and the peripheral length on the photosensitive member surface, on the basis of the rotating direction of the photosensitive member, from the exposure position to the transfer position on the photosensitive member.

3. A color electrophotographic apparatus comprising:

an image forming unit group containing a plurality of image forming units, each image forming unit comprising a rotatable photosensitive member, and developing means having a toner of different color than others and forming a toner image on the photosensitive member, a rotatable transfer member on which the toner image on the photosensitive member is overlaid and transferred, and a color image is formed, position detecting means for detecting a specific position on the transfer member, transfer means for transferring the toner image on the photosensitive member to the transfer member at a transfer position, exposure means for exposing the image at an exposure position, said exposure position being a specific distance from the transfer position, moving means for moving the image forming unit group to sequentially position each image forming unit at an image forming position defining said exposure position and transfer position, and driving means for driving by selecting as the moving speed of the transfer member, a first running speed used when forming an image, or a second running speed slower than the first running speed, said second running speed including a stopping state of the transfer member, wherein the position detecting means is adjusted to detect the position of the transfer member after changing over the speed of the transfer member from the second running speed to the first running speed.

4. A color electrophotographic apparatus comprising:

a plurality of image forming units, each image forming unit having a photosensitive member, and developing means for developing the photosensitive member, an image forming unit group comprising said plurality of image forming units in an annular form and rotatable about an axis of rotation, a transfer member on which a toner image developed on the photosensitive member is overlaid and transferred at a transfer position, and a color image is formed, exposure means for exposing an image at an exposure position, said exposure position being a specific distance from the transfer position, moving means for moving the image forming unit group to sequentially position each image forming unit at an image forming position defining said exposure position and transfer position, and discharging means for erasing the surface electric charge of the photosensitive member, being disposed outside the image forming unit group, near the image forming position, at the downstream side of the transfer position and at the upstream side of a cleaner part which is disposed inside the image forming unit on the basis of the rotating direction of the photosensitive member.

5. A color electrophotographic apparatus comprising:

a plurality of image forming units, each image forming unit having a photosensitive member, and developing means for developing the photosensitive member, an image forming unit group comprising said plurality of image forming units in an annular form and rotatable about an axis of rotation, a transfer member on which a toner image developed on the photosensitive member is overlaid and transferred at a transfer position, and a color image is formed, exposure means for exposing an image at an exposure position, said exposure position being a specific distance from the transfer position, and moving means for moving the image forming unit group to sequentially position each image forming unit at an image forming position defining said exposure position and transfer position, wherein the movement of the image forming unit group by rotation is interrupted for a predetermined time for positioning each image forming unit at a position other than the image forming position.

6. A color electrophotographic apparatus of claim 5, wherein each image forming unit is present at the image forming position only when the toner image is being transferred from the photosensitive member to the transfer member, and each image forming unit avoids otherwise contacting the transfer member.

7. A color electrophotographic apparatus comprising:

a plurality of image forming units, each image forming unit having a photosensitive member, developing means for developing the photosensitive member, a first hopper for feeding a developer mixing carrier and a toner into the developing means, toner refill means for supplying the toner into the first hopper, a second hopper for supplying the toner to the first hopper through the toner refill means, and toner amount detecting means for detecting a toner amount in the second hopper, an image forming unit group comprising said plurality of image forming units in an annular form and rotatable about an axis of rotation, a transfer member on which a toner image developed on the photosensitive member is overlaid and transferred at a transfer position, and a color image is formed, exposure means for exposing an image at an exposure position, said exposure position being a specific distance from the transfer position, moving means for moving the image forming unit group to sequentially position each image forming unit at an image forming position defining said exposure position and transfer position, and toner concentration detecting means for detecting a toner concentration of the developer in each image forming unit, being disposed outside of each image forming unit positioned at the image forming position, wherein, when the toner amount detecting detects the toner amount in the second hopper, if the toner amount detecting means detects no toner amount, the image forming unit group is rotated by the moving means, and the toner amount detecting means detects again the toner amount in the second hopper, and if the toner amount detecting means detects no toner amount again, it is finally judged that there is no toner.

8. A color electrophotographic apparatus comprising:

a plurality of image forming units, each image forming unit having a rotatable photosensitive member, and developing means possessing a toner of different color from others for forming a toner image on the photosensitive member, an image forming unit group comprising said plurality of image forming units in an annular form and rotatable about an axis of rotation, a transfer member on which a toner image developed on the photosensitive member is overlaid and transferred at a transfer position, and a color image is formed, second transfer means for transferring the toner image on the transfer member onto paper, exposure means for exposing an image at an exposure position, said exposure position being a specific distance from the transfer position, and moving means for moving the image forming unit group to sequentially position each image forming unit at an image forming position defining said exposure position and transfer position, wherein, after a power source turns on, each image forming unit is initially rotated by the moving means without being accompanied by a specified initializing action, and a predetermined time after the power source turns on, each image forming unit is rotated by the moving means accompanied by the specified initializing action.

9. A color electrophotographic apparatus comprising:

a plurality of image forming units, each image forming unit having a rotatable photosensitive member, and developing means possessing a toner of different color from others for forming a toner image on the photosensitive member, an image forming unit group comprising said plurality of image forming units in an annular form and rotatable about an axis of rotation, a transfer member on which a toner image developed on the photosensitive member is overlaid and transferred at a transfer position, and a color image is formed, transfer means for transferring the toner image on the photosensitive member at the transfer position onto the transfer member, exposure means for exposing an image at an exposure position, said exposure position being a specific distance from the transfer position, and moving means for moving the image forming unit group to sequentially position each image forming unit at an image forming position defining said exposure position and transfer position, wherein each image forming unit is rotated by the moving means if the image forming action by each image forming unit is not effected for more than a specific time with a power source being turned on.

10. An image forming unit used in a color electrophotographic unit which comprises:

a plurality of image forming units, each image forming unit having a photosensitive member, and developing means possessing a toner of different color from others for forming a toner image on the photosensitive member, an image forming unit group comprising said plurality of image forming units in an annular form and rotatable about an axis of rotation, a transfer member on which a toner image developed on the photosensitive member is overlaid and transferred at a transfer position, and a color image is formed, exposure means for exposing an image at an exposure position, said exposure position being a specific distance from the transfer position, and moving means for moving the image forming unit group to sequentially position each image forming unit at an image forming position defining said exposure position and transfer position, wherein a guide member is provided in a substantially radial direction to the axis of rotation, at least at the inner wall in a substantially vertical relation to the axis of rotation, in each image forming unit.

11. An image forming unit used in a color electrophotographic unit which comprises:

a plurality of image forming units, each image forming unit having a photosensitive member, developing means possessing a toner of different color from others for forming a toner image on the photosensitive member, and a cleaner for cleaning the toner, an image forming unit group comprising said plurality of image forming units in an annular form and rotatable about an axis of rotation, a transfer member on which a toner image developed on the photosensitive member is overlaid and transferred at a transfer position, and a color image is formed, exposure means for exposing an image at an exposure position, said exposure position being a specific distance from the transfer position, and moving means for moving the image forming unit group to sequentially position each image forming unit at an image forming position defining said exposure position and transfer position, wherein a developing means wall of a first image forming unit of two adjacent image forming units of the image forming unit group and a cleaner wall of a second image forming unit of said two adjacent image forming units constitutes a set of optical path walls, a gap between said set of optical path walls forming an optical path of the exposure means, and the optical path walls are planes substantially parallel to each other.

12. An image forming unit used in a color electrophotographic unit which comprises:

a plurality of image forming units, each image forming unit having a photosensitive member, and developing means possessing a toner of different color from others for forming a toner image on the photosensitive member, an image forming unit group comprising said plurality of image forming units in an annular form and rotatable about an axis of rotation, a transfer member on which a toner image developed on the photosensitive member is overlaid and transferred at a transfer position, and a color image is formed, exposure means for exposing an image at an exposure position, said exposure position being a distance from the transfer position, and moving means for moving the image forming unit group to sequentially position each image forming unit at an image forming position defining said exposure position and transfer position, wherein the gap between two adjacent image forming units of the image forming unit group constitutes a set of walls for forming an optical path of the exposure means, and the walls are planes substantially parallel to each other, wherein the gap between the two adjacent image forming units of the image forming unit group is 20 mm or less.

13. An image forming unit used in a color electrophotographic unit which comprises:

a plurality of image forming units, each image forming unit having a photosensitive member, and developing means possessing a toner of different color from others for forming a toner image on the photosensitive member, an image forming unit group comprising said plurality of image forming units in an annular form and rotatable about an axis of rotation, a transfer member on which a toner image developed on the photosensitive member is overlaid and transferred at a transfer position, and a color image is formed, exposure means for exposing an image at an exposure position, said exposure position being a distance from the transfer position, and moving means for moving the image forming unit group to sequentially position each image forming unit at an image forming position defining said exposure position and transfer position, wherein the gap between two adjacent image forming units of the image forming unit group constitutes a set of walls for forming an optical path of the exposure means, and the walls are planes substantially parallel to each other, wherein the color of the walls of the two adjacent image forming units for forming the optical path is black.

* * * * *

UNITED STATES PATENT AND TRADE MARK OFFICE

CERTIFICATE OF CORRECTION

PATENT NO. : 5,587,783
DATED : December 24, 1996
INVENTOR(S) : NAKAMURA ET AL.

It is certified that error appears in the above-identified patent and that said Letters Patent is hereby corrected as shown below:

On the cover page, in the Abstract, item [57], line 8, between the words "supplied" and "the" insert the word --to--.

Signed and Sealed this

Third Day of June, 1997

*Attest:*

*Attesting Officer*

BRUCE LEHMAN

*Commissioner of Patents and Trademarks*